US006773246B2

(12) United States Patent
Tsao et al.

(10) Patent No.: US 6,773,246 B2
(45) Date of Patent: Aug. 10, 2004

(54) ATOMIZING APPARATUS AND PROCESS

(76) Inventors: Chi-yuan A. Tsao, No.203-2, Wu-Fei St., Tainan (TW); Yain-Hauw Su, No. 3, Lane 84, An-Chung Road, Shin-Tien, Taipei Hsien (TW); Yain-Ming Chen, No. 16 Lane 226, West Sec. Tsu-Yu Road, Pintung (TW); Ray-Wen Lin, No. 319, Der-Hauh St., Taichung (TW)

( * ) Notice: Subject to any disclaimer, the term of this patent is extended or adjusted under 35 U.S.C. 154(b) by 0 days.

(21) Appl. No.: 09/956,387

(22) Filed: Sep. 19, 2001

(65) Prior Publication Data

US 2002/0076458 A1 Jun. 20, 2002

Related U.S. Application Data

(60) Continuation-in-part of application No. 09/388,494, filed on Sep. 2, 1999, now abandoned, which is a division of application No. 08/751,970, filed on Nov. 19, 1996, now Pat. No. 5,993,509.

(51) Int. Cl.[7] ..... B22F 9/08; B29B 9/08

(52) U.S. Cl. ..... 425/6; 75/338; 222/603; 264/12; 425/135

(58) Field of Search ..... 425/6, 7, 135, 425/162; 222/603; 266/202; 75/338, 339, 355; 264/12

(56) References Cited

U.S. PATENT DOCUMENTS 3,357,808 A * 12/1967 Eberle ..... 65/647
3,428,718 A * 2/1969 Helin et al. ..... 75/337
3,554,521 A * 1/1971 Firbeck ..... 266/158
3,663,206 A * 5/1972 Lubanska ..... 75/337
3,752,611 A * 8/1973 Reed et al. ..... 425/7
4,472,329 A * 9/1984 Muschelknautz et al. ..... 264/12
4,810,284 A * 3/1989 Auran et al. ..... 75/338
5,190,701 A * 3/1993 Larsson ..... 264/8
5,196,049 A * 3/1993 Coombs et al. ..... 75/338
6,444,009 B1 * 9/2002 Liu et al. ..... 75/332

* cited by examiner

*Primary Examiner*—Joseph Drodge
*Assistant Examiner*—Emmanuel Luk
(74) *Attorney, Agent, or Firm*—Brown & Michaels, PC

(57) ABSTRACT

An atomizing apparatus for the production of powders or spray deposits, having an atomization device for receiving a liquid stream of molten metal or metal alloy to be atomized; at least two primary atomization gas jets for directing an atomization gas at an angle into the liquid stream in an atomization zone at an impinging point of the atomization jets to break the stream into atomized droplets; and at least two secondary jets for direction a controlling fluid at a pressure, flow rate and direction, the jets being aimed at the atomization gas jet or into the atomization zone, wherein said secondary jets control a backpressure generated by the primary atomization gas jets. The apparatus also includes means for in-situ controlling at least one of the relative positions among the primary atomization jets, the secondary jets, and the liquid delivery nozzle.

18 Claims, 26 Drawing Sheets

(a) A035

(b) A036

(c) A037

(d) A038

(e) A039

(f) A040

(g) A042

(h) A043

(i) A044

Pu = 0.04 MPa

Pu = 0.06 MPa

Pu = 0.08 MPa

Pu = 0.10 MPa

Pu = 0.14 MPa

Pu = 0.20 MPa

Pu = 0.40 MPa

ATOMIZING APPARATUS AND PROCESS

REFERENCE TO RELATED APPLICATIONS

This is a continuation-in-part of application Ser. No. 09/388,494, filed Sep. 2, 1999, now abandoned entitled "Atomizing Apparatus & Process", which was a divisional application of parent patent application Ser. No. 08/751,970, filed Nov. 19, 1996, now U.S. Pat No. 5,993,509, issued Nov 30, 1999. The aforementioned application(s) are hereby incorporated herein by reference.

FIELD OF THE INVENTION

This invention relates to a method and apparatus for atomizing a liquid stream of metal or metal alloy. This invention relates to producing powders as well as to spray deposition process.

DESCRIPTION OF RELATED ART

For both powder production and spray deposition process, there are traditionally two kinds of atomization devices for atomizing a liquid stream of metal or metal alloys coming out of the liquid delivery nozzle into a spray of droplets. One is the "Free Fall" type of design, in which the stream of metal or metal alloy is atomized at a certain distance away from the exit of the liquid delivery nozzle. The other design is the "Confined" type of design, in which the stream of metal or metal alloy is atomized at the exit of the liquid delivery nozzle. The Confined type of atomization device gives more efficient and uniform transfer of energy from atomization gas to the stream of metal or metal alloy, due to the shorter distance between the atomization gas and the stream of metal or metal alloy and prefilming of the molten metal or metal alloy over the end of the liquid delivery nozzle. However, since the impingement point of the atomization gas is close to the exit of the liquid delivery nozzle, the molten metal or metal alloy is easier to freeze-up inside the liquid delivery nozzle, which blocks further atomization. The Free-Fall type atomization device doesn't have the freeze-up problem; however, the atomization efficiency is reduced compared to the Confined type of atomization device, resulting in coarser atomized powder and coarser microstructures due to a lower cooling rate.

During atomizing, a backpressure is created by the impingement of the atomization gas jets around the atomization zone below the exit of the liquid deliver nozzle. The backpressure has two effects. One effect is generating backsplash during atomization, in which molten metal or metal alloy is backsplashed upwards away from the atomization zone. The backsplashed molten metal or metal alloy may either deposit back onto the atomization device and block further atomization, or become coarse and irregular shaped powders, which may not be desired. Another effect is influencing the atomization rate, or the flow rate of the metal or metal alloy stream coming out of the liquid delivery nozzle. In the extreme, a complete blockage of the metal or metal alloy stream from coming out of the liquid delivery nozzle is likely to happen due to the backpressure. The present invention provides a method of atomizing and an atomizing apparatus to control the backpressure.

During atomizing, the intensities and directions of the atomization gas jets affect the atomization characteristics, such as atomization efficiency, atomization rate, the cooling rate of atomized droplets, trajectories and velocities of atomized droplets, shapes and sizes of atomized droplets, the spatial flux distribution of atomized droplets, etc. The intensities of the atomization gas jets are manipulated through controlling the pressure and/or flow rate of the atomization gas. However, the directions of the atomization gas jets are fixed by the design of the atomization device. In U.S. Pat. No. 4,779,802, and U.S. Pat. No. 4,905,899, the atomization device is scanned to control the directions of the atomization gas jets. The present invention provides a method of atomizing and an atomizing apparatus to control both the intensities and directions of the atomization gas jets.

SUMMARY OF THE INVENTION

One aspect of the present invention is to control the created backpressure, which, in turn, controls the backsplash and the atomization rate, or the flow rate of the metal or metal alloy stream coming out of the liquid delivery nozzle. Another aspect of the present invention is to control the atomization characteristics by controlling the intensities and directions of the atomization gas jets, which, in turn, controls the droplet characteristics, such as the variations of size, shape, temperature, heat content and microstructure of droplets, etc., and/or powder characteristics, such as powder size distribution, the powder shape distribution, the microstructure variations of powders, etc., and/or spray-deposit characteristics, such as the morphology, macrostructures and microstructures of the deposit, etc.

According to one aspect of the present invention there is provided a method of atomizing a liquid stream of metal or metal alloy consisting of the steps of:

teeming a stream of molten metal or metal alloy into an atomization device, atomizing the stream with atomization gas to form droplets of metal or metal alloy, and directing controlling fluid at an atomization gas jets or at atomization zone to control the backpressure and, if desired, the intensities and directions of the atomization gas jets.

Preferably the atomization gas issues from first jets, and the controlling fluid issues from second jets directed at the atomization gas jets or at the atomization zone. The intensity, flow rate and pressure of the secondary jets are preset to control or are in-situ adjusted to in-situ control the backpressure and/or the intensities and directions of the atomization gas jets. The method may be for the production of powder to control the powder characteristics. Alternatively, the method may be for the production of spray deposits to control the deposit characteristics. Alternatively, the secondary jets may be so arranged, through which solid particles or whiskers of the same or different composition (either metallic or non-metallic) of the metal to be atomized are introduced into the controlling fluid which acts as a transport vehicle for the particles or whiskers to be co-deposited with the atomized droplets to form spray-deposited composite materials. Alternatively, the particles or whiskers are introduced from above the secondary jets, which also gives a mixture of the particles or whiskers with the spray to form spray-deposited composite materials. Suitably, the controlling fluid is an inert gas, such as Argon, Helium and Nitrogen, or air. Alternatively, the controlling fluid may be cryogenic liquefied gas which changes to a gaseous phase upon heating by the metal or metal alloy stream. The atomization gas is suitably an inert gas, such as Argon, Helium and Nitrogen, or Air. The selection of gases is made in accordance with the compatibility with the liquid metal or metal alloy to be atomized.

According to another aspect of the invention there is provided an atomizing apparatus consisting of an atomization device for receiving a stream of molten metal or metal alloy to be atomized, means for directing atomization gas at the liquid stream to atomize the stream, and means for directing controlling fluid at atomization gas jets or at an atomization zone to control the backpressure and/or the atomization characteristics. In the preferred arrangement, the means for directing the atomization gas consists of primary jets and the means for directing the controlling fluid consists of secondary jets directed at the atomization gas jets or at the atomization zone. The intensity, flow rate and pressure of the secondary jets are preset to control or are in-situ adjusted to in-situ control the backpressure and/or the intensities and directions of the atomization gas jets. Suitably, the controlling fluid is an inert gas, such as Argon, Helium and Nitrogen, or air. Alternatively, the controlling fluid may be cryogenic liquefied gas which changes to a gaseous phase upon heating by the metal or metal alloy stream. The atomization gas is suitably an inert gas, such as Argon, Helium and Nitrogen, or air. The selection of gases is made in accordance with the compatibility with the liquid metal or metal alloy to be atomized.

Alternatively, the apparatus may be used to produce spray deposits on a suitable collector.

DETAILED DESCRIPTION OF THE INVENTION

Figure 1:
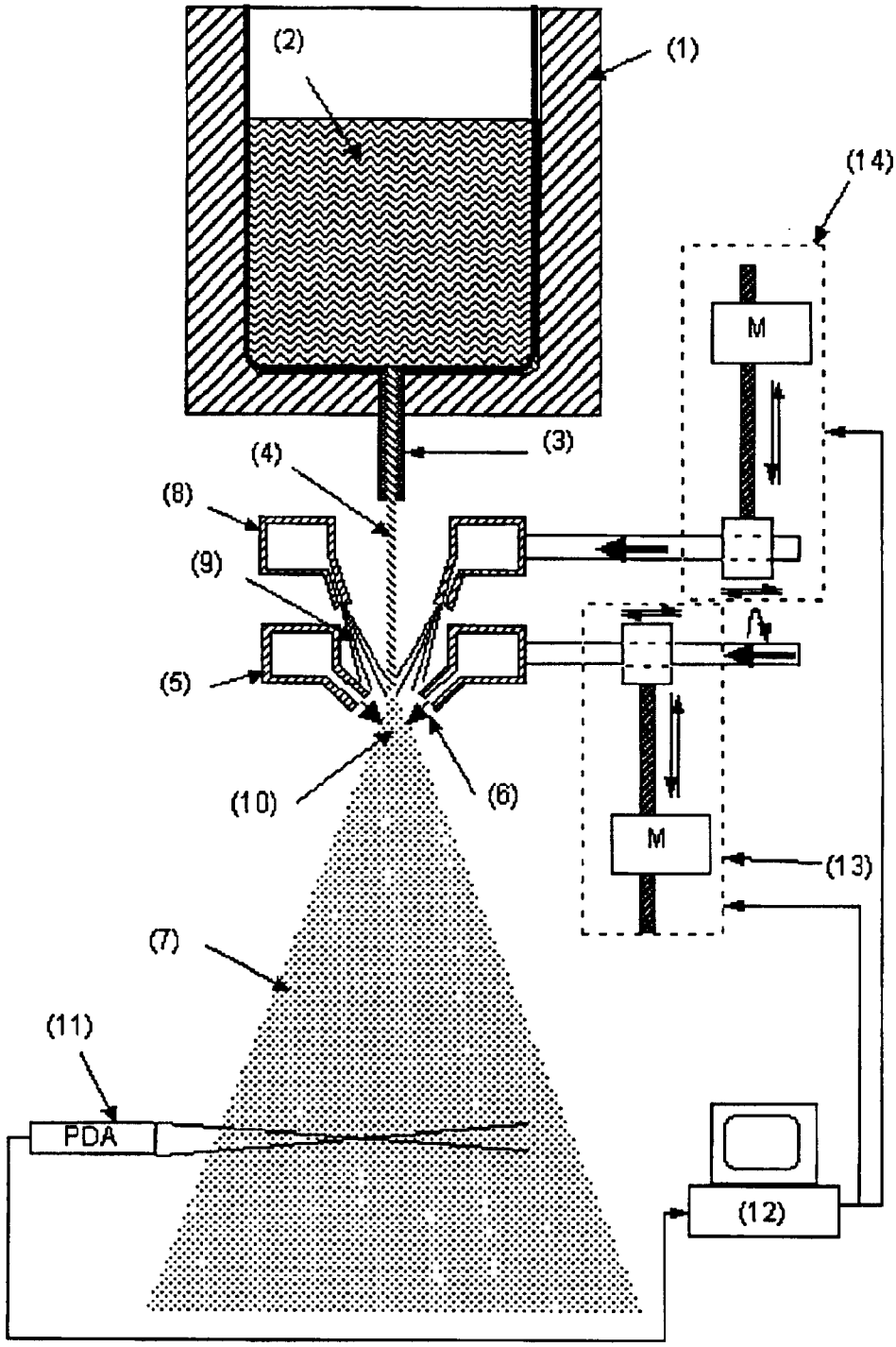
FIG. 1 is a schematic sectional side elevation of a gas atomizing apparatus according to the invention.

In FIG. 1, an atomizing apparatus for gas atomizing liquid metal or alloy is shown consisting of a refractory or refractory lined crucible or tundish (1) for containing liquid metal or metal alloy (2). The crucible (1) has a liquid delivery nozzle (3) to provide a liquid metal or metal alloy stream (4) of a desired diameter. The liquid metal or metal alloy stream (4) teems into a central opening in a primary gas atomization device (5) which causes a number of atomization gas jets (6) to be directed at the liquid metal or metal alloy stream (4) so as to atomize the stream into a spray of atomized droplets (7). The primary atomization gas jets (6) preferably spray Nitrogen, Argon or Helium, but air may also be used. The atomizing assembly also consists of a secondary controlling fluid jets device (8), disposed upstream of the primary atomization gas jets (6), containing a number of controlling fluid jets (9) which apply Nitrogen, Argon, Helium, air, or cryogenic liquefied gas to the atomization gas jets (6) or to the atomization zone (10). The pressure and flow rate of the controlling fluid applied at the secondary controlling fluid jets device (8) is controlled to manipulate the backpressure and the atomization characteristics. The controlling can be made in-situ during atomizing.

The atomization characteristics, such as mass flux distribution, droplet size distribution and droplet velocity, can be detected by the sensors, such as Phase-Doppler Anemometry (PDA) (11), and be fed back to the central process unit, such as computer (12). The central process unit (12) then sends a command after calculation to actuate the position driver of primary gas atomization device (13) and/or position driver of secondary controlling fluid jets device (14) to in-situ control the relative positions among the primary atomization device (5), the secondary controlling fluid jets device (8), and/or the liquid delivery nozzle (3).

Figure 2:
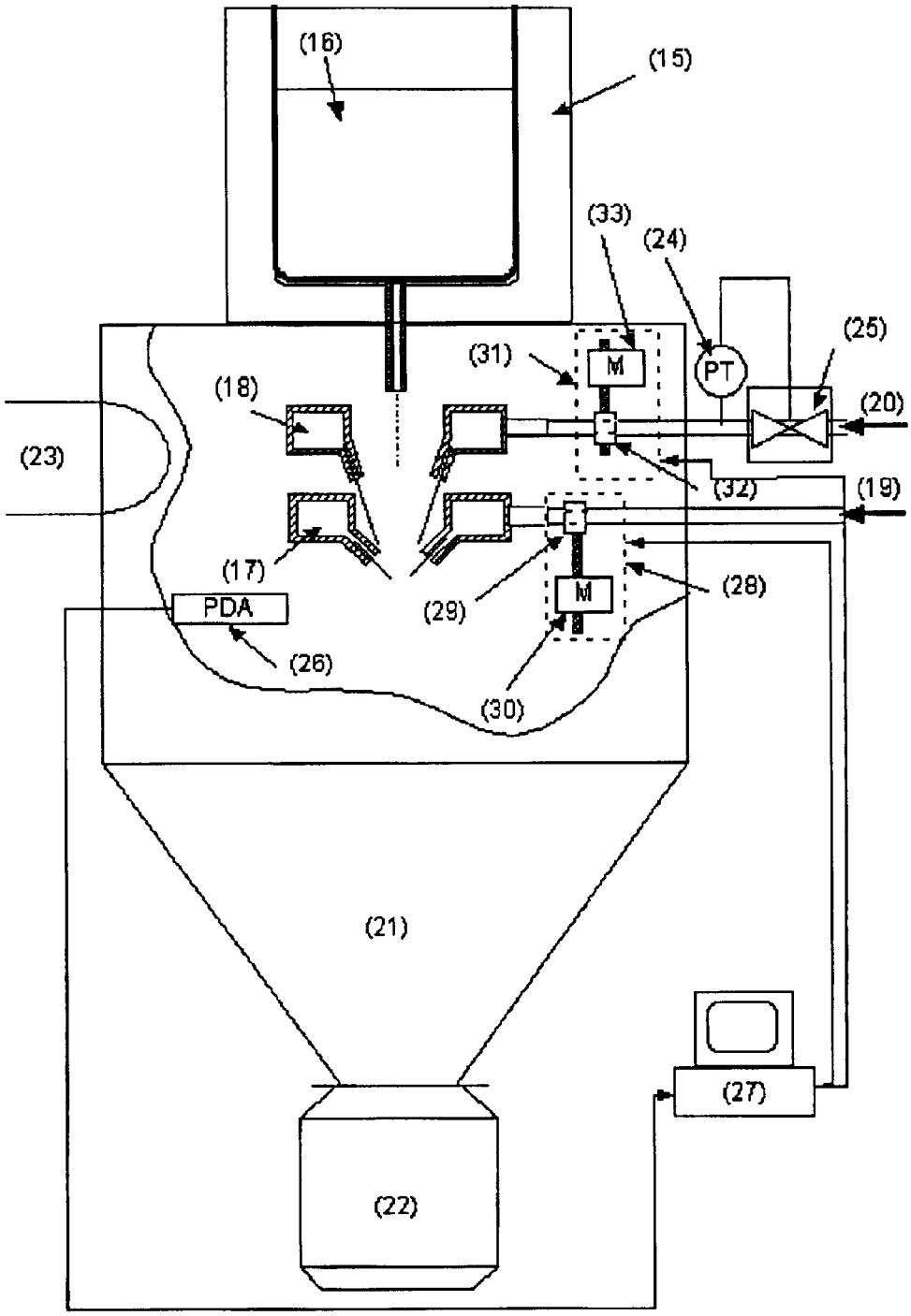
FIG. 2 is a schematic side elevation of apparatus for producing powders including the atomizing apparatus according to the invention together with an alternative base arrangement.

FIG. 2 shows the apparatus of FIG. 1 as applied to powder production apparatus. In this figure, the crucible/tundish metal dispensing system (15) with liquid metal (16), the gas atomization device (17) and the controlling fluid jets device (18) are positioned on a spray chamber (21). Atomization gas is supplied to the gas atomization device (17) via an inlet pipe (19), and controlling fluid is supplied to the controlling fluid jets device (18) via a separate inlet pipe (20). At the base of the spray chamber is a powder collection vessel (22), the chamber additionally containing a gas exhaust pipe (23). The flow rate of the controlling fluid applied at the secondary controlling fluid jets device (18) is controlled by activating the controlling fluid control valve (25) via a current to pneumatic pressure (P/I) converter (24). The controlling can be made in-situ during atomizing. The atomization characteristics, such as mass flux distribution, droplet size distribution, and droplet velocity, can be detected by the sensors, such as Phase-Doppler Anemometry (PDA) (26) and be fed back to the central process unit, such as computer (27). The central process unit (27) then sends a command after calculation to actuate the position driver of primary gas atomization device (28) and/or position driver of secondary controlling fluid jets device (31) to in-situ control the relative positions among the atomization device (5), the secondary controlling fluid jets device (8), and/or the liquid delivery nozzle (3). The horizontal and vertical movements of the primary atomization device (5) are controlled by one set of the horizontal actuator (29) and vertical actuator (30), respectively. The horizontal and vertical movements of the secondary controlling fluid jets device (8) are controlled by another set of the horizontal actuator (32) and vertical actuator (33), respectively.

During atomizing, the backpressure is controlled by the controlling fluid jets device, which controls the extent of the backsplash and the atomization rate, or the flow rate of the metal or metal alloy stream coming out of the liquid delivery nozzle. In addition, the intensities and directions of the atomization gas jets are controlled by the controlling fluid jets device, which controls the atomization characteristics. Consequently, the droplet characteristics, such as the variations of size, shape, temperature, heat content and microstructure of droplets, etc., and powder characteristics, such as powder size distribution, the powder shape distribution, the microstructure variations of powders, etc., are controlled. The pressure and/or flow rate of the controlling fluid are in-situ adjustable during atomizing to in-situ control the backpressure and/or the intensities and directions of the atomization gas jets.

EXAMPLE OF THE USE OF NITROGEN GAS AS THE CONTROLLING FLUID IN THE ATOMIZATION OF WATER

The example below illustrates the principles of selecting the process parameters by illustrating the conditions used for the atomization of water employing the controlling fluid technique. $P_u$ is the nitrogen gas pressure used for the controlling fluid jets device, $P_1$ is the nitrogen gas pressure used for the gas atomization device, and R is the vertical distance between the controlling fluid jets device and gas atomization device.

The principles of selection of R is discussed below for this example. When R>25 mm, the controlling fluid jets device was too far from the gas atomization device, so that when the controlling fluid became large enough to suppress the backpressure, the water was atomized by the controlling fluid also, which rendered the controlling fluid jets device meaningless. When R<5 mm. As a result, the R needed to be limited between 5 mm and 25 mm in this example.

Figure 3:
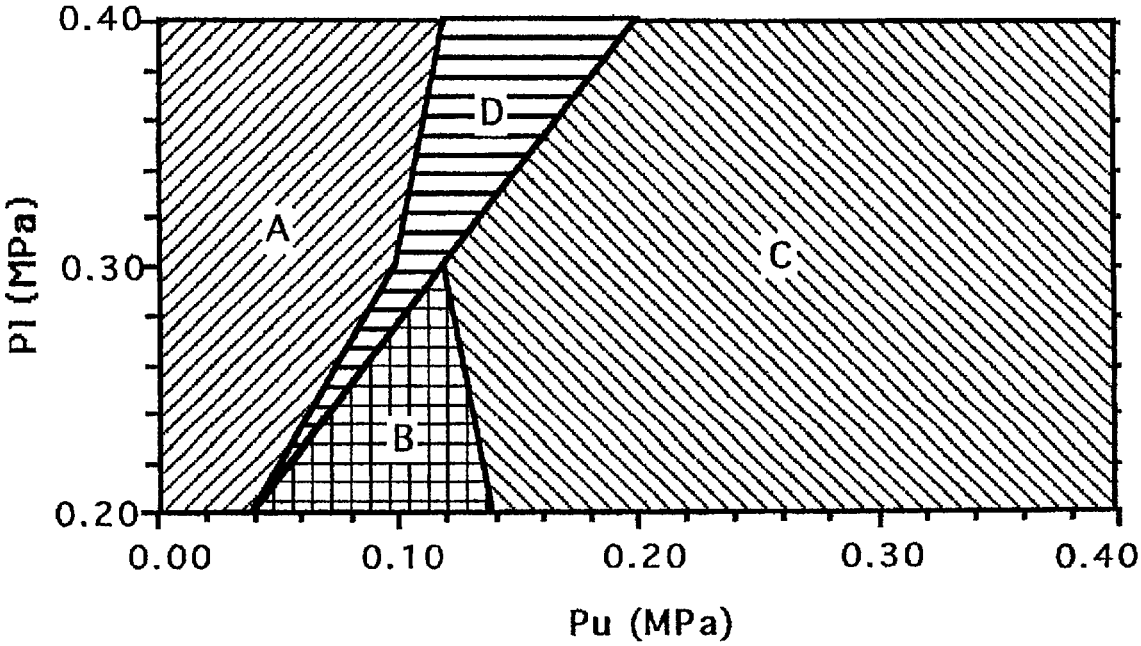
FIG. 3 is a Process Map of $P_u$ vs. $P_1$ for R=15 mm for water atomization.
Figure 4:
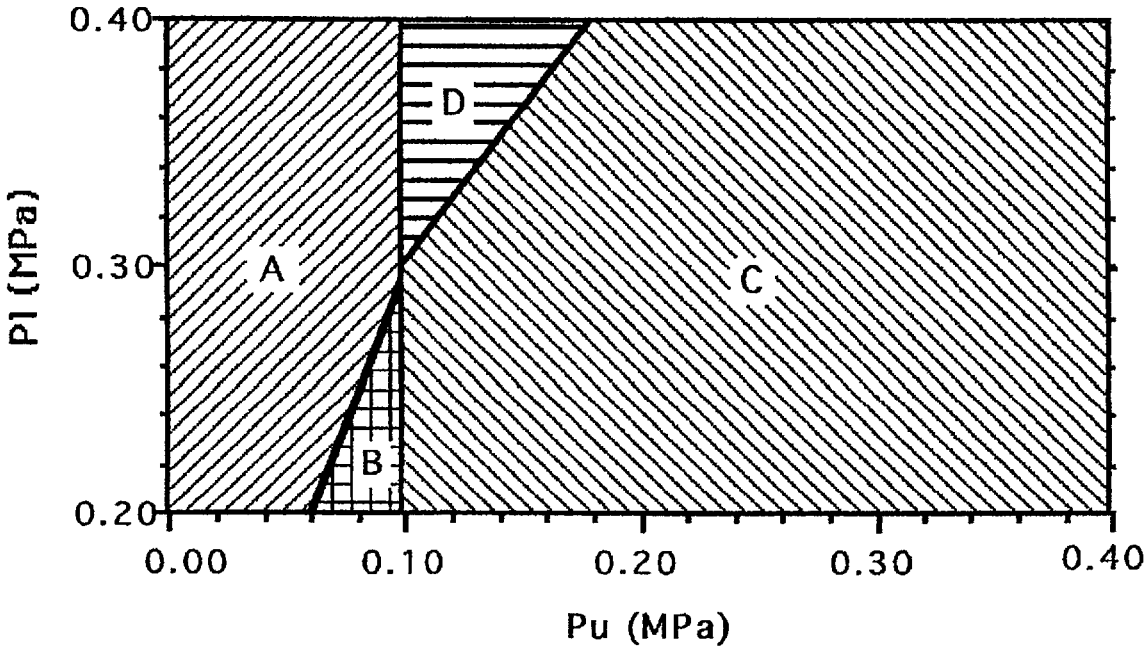
FIG. 4 is a Process Map of $P_u$ vs. $P_1$ for R=20 mm for water atomization.
Figure 5:
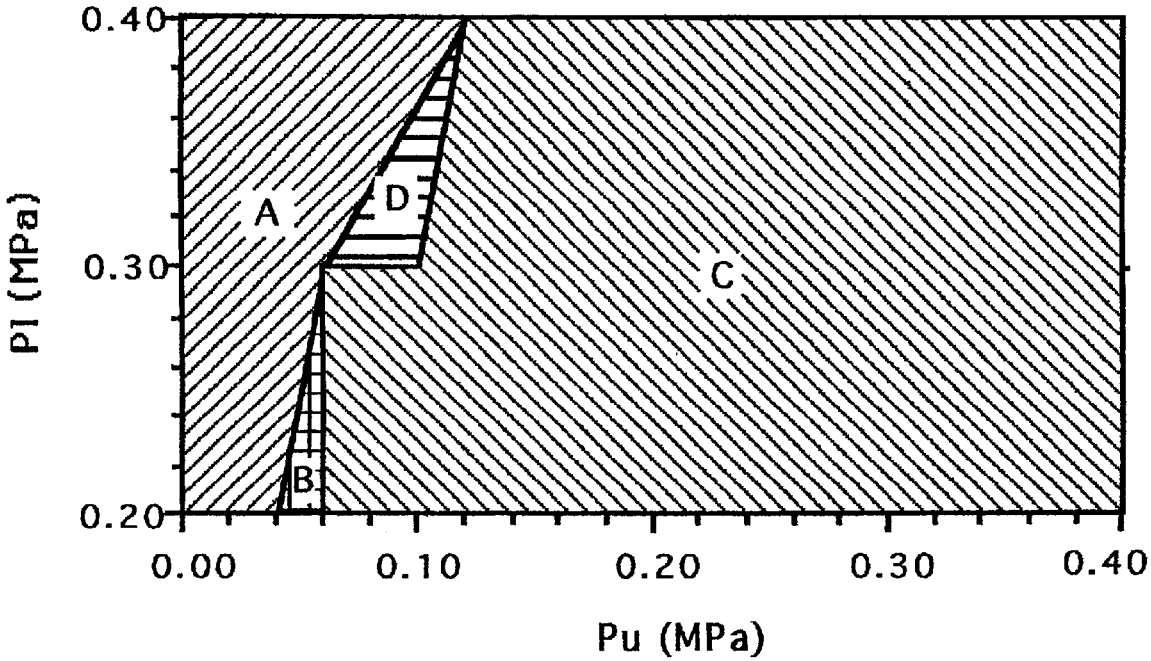
FIG. 5 is a Process Map of $P_u$ vs. $P_1$ for R=25 mm for water atomization.
Figure 6:
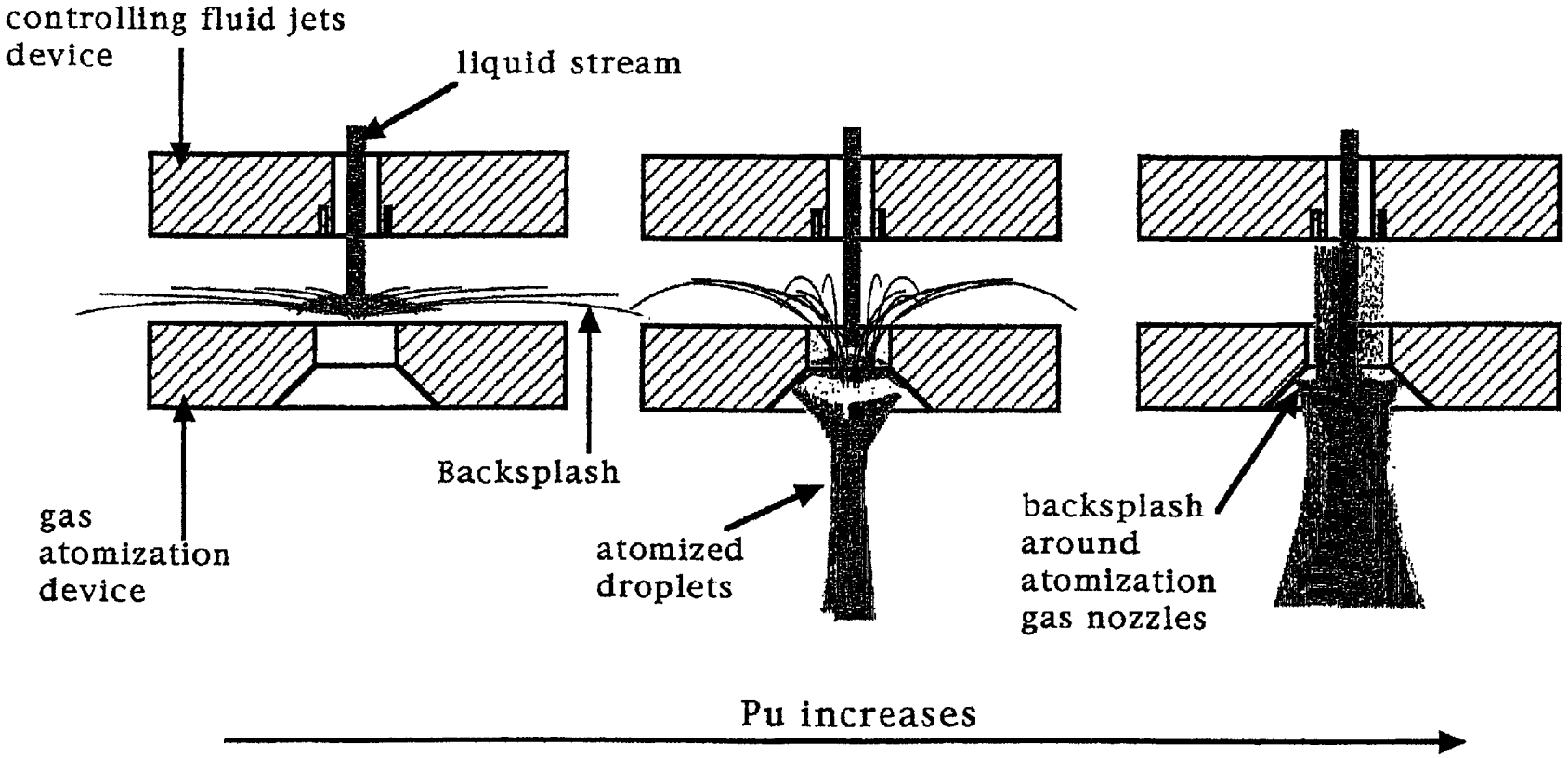
FIG. 6 shows the atomization phenomena for region A in the Process Map of $P_u$ vs. $P_1$.
Figure 7:
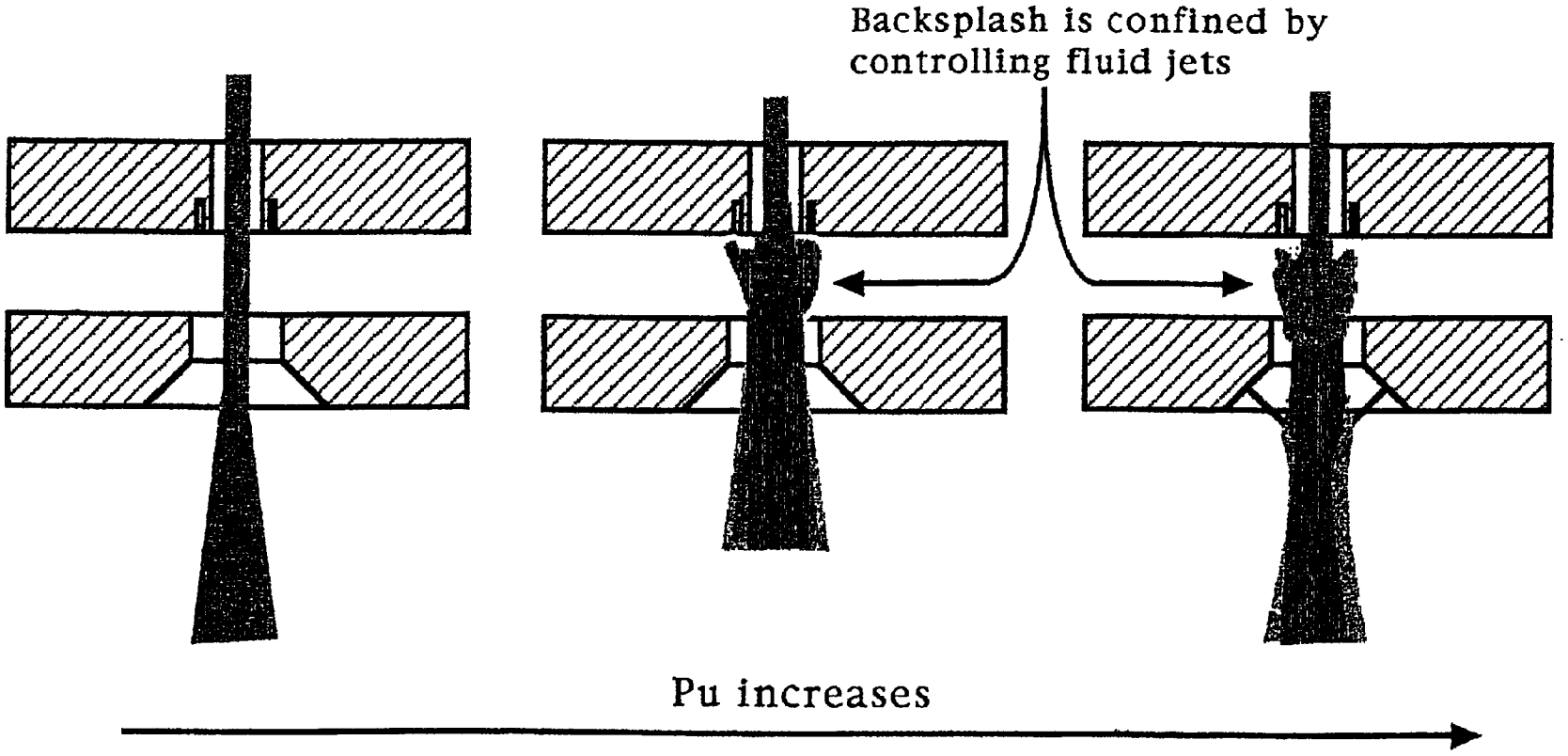
FIG. 7 shows the atomization phenomena for region B in the Process Map of $P_u$ vs. $P_1$.
Figure 8:
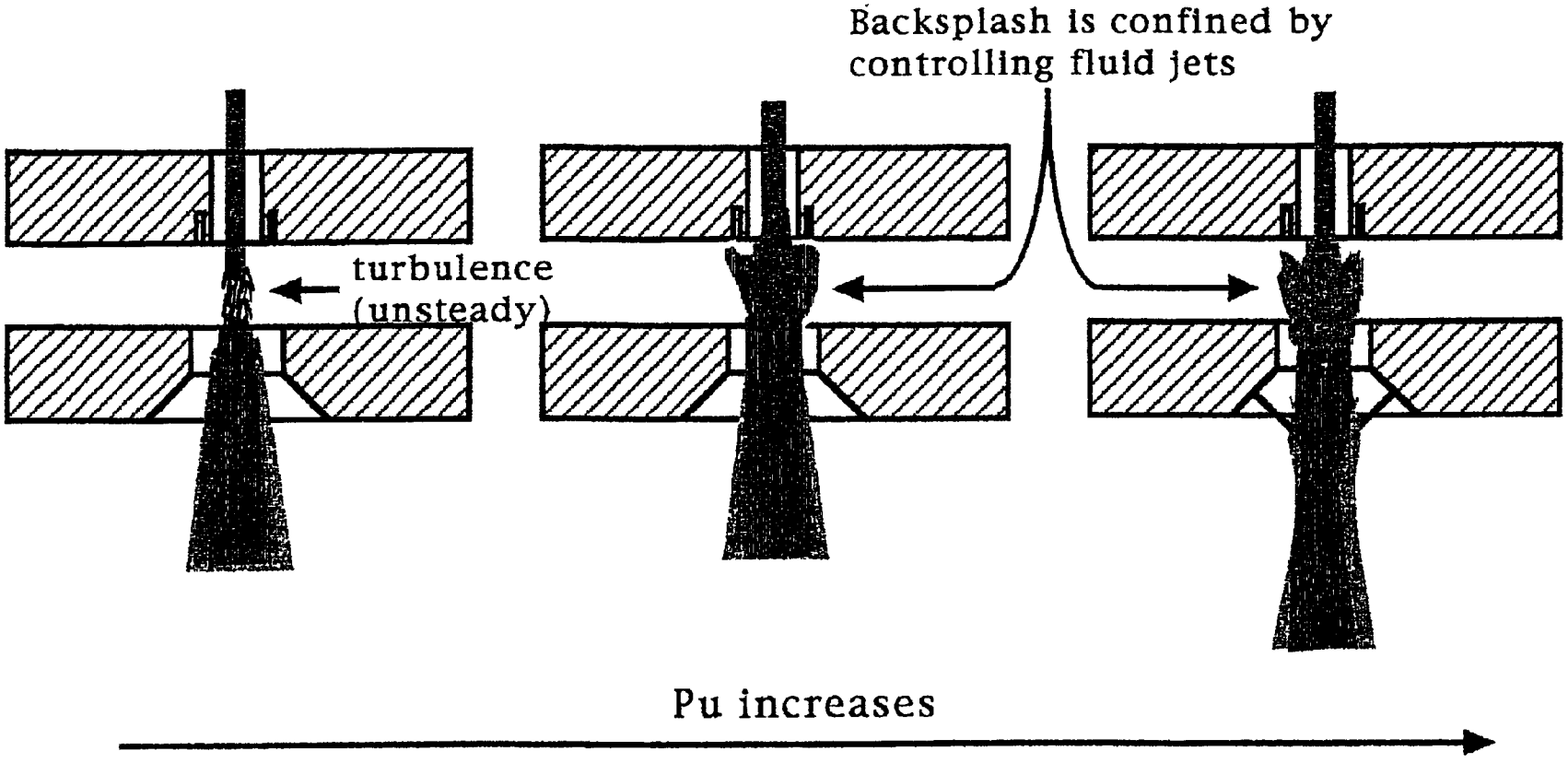
FIG. 8 shows the atomization phenomena for region C in the Process Map of $P_u$ vs. $P_1$.
Figure 9:
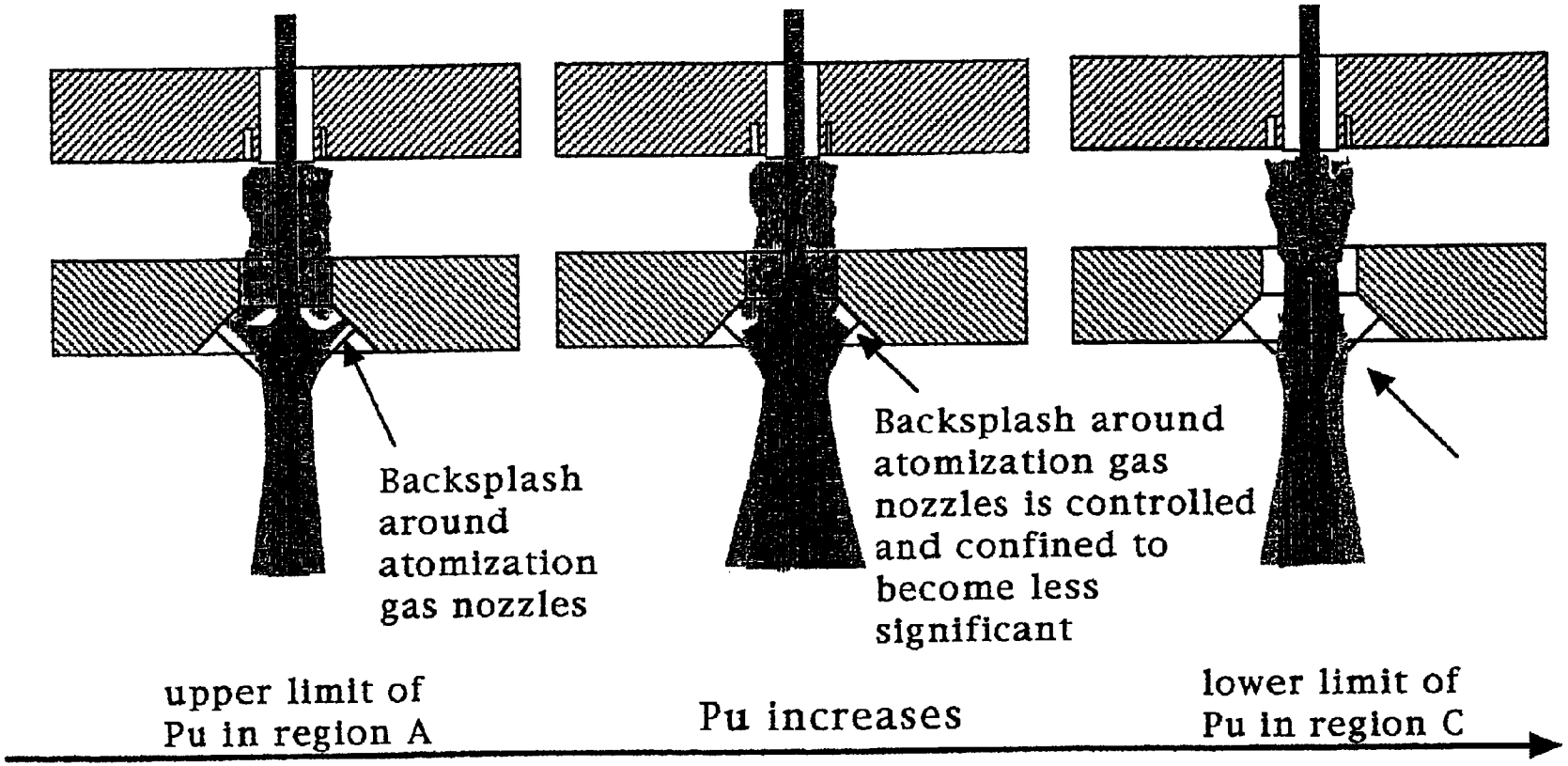
FIG. 9 shows the atomization phenomena for region D in the Process Map of $P_u$ vs. $P_1$.

The principles of selection of $P_u$ and $P_1$ is discussed below for this example. FIGS. 3, 4, and 5 show the Process Maps of $P_u$ vs. $P_1$ for R=15, 20, and 25 mm, respectively. In the figures, each map is divided into Regions A, B, C, and D. The effects of the controlling fluid jets device on the atomization characteristics of water for each Region are shown schematically in FIGS. 6 to 9, separately. In Region A, the controlling fluid jets are not able to suppress the backpressure completely. In Regions B and C, the backpressure is suppressed by the controlling fluid jets device; however, the water stream between the controlling fluid jets device and gas atomization device in Region C is more turbulent than that in Region B. Region D is the transition region between Region A and Regions B or C. In summary, Regions B and C are the regions suitable for water atomization in this example.

EXAMPLE OF THE USE OF NITROGEN GAS AS THE CONTROLLING FLUID IN THE PRODUCTION OF Pb—Sn POWDERS

The example below illustrates the conditions used for the production of Pb-50 wt % Sn powders. Table 1 lists the process parameters used for the production of powders. $P_u$ is the nitrogen gas pressure used for the controlling fluid jets device, $P_1$ is the nitrogen gas pressure used for the gas atomization device, and R is the vertical distance between the controlling fluid jets device and gas atomization device.

TABLE 1

| Experimental No. | $P_1$ (Mpa) | $P_u$ (Mpa) | R (mm) |
|---|---|---|---|
| A035 | 0.40 | 0.20 | 25 |
| A036 | 0.30 | 0.30 | 25 |
| A037 | 0.20 | 0.20 | 15 |
| A038 | 0.30 | 0.20 | 20 |
| A039 | 0.20 | 0.30 | 20 |
| A040 | 0.40 | 0.40 | 20 |

TABLE 1-continued

| Experimental No. | $P_1$ (Mpa) | $P_u$ (Mpa) | R (mm) |
|---|---|---|---|
| A042 | 0.30 | 0.40 | 15 |
| A043 | 0.40 | 0.30 | 15 |
| A044 | 0.20 | 0.40 | 25 |

Table 2 lists the first and second peak values of the distribution of powder sizes. For the condition of $P_u$=0, $P_1$=0.30 MPa and R=20 mm, the backsplash created due to the backpressure was so severe that nearly no atomization took place, which resulted in no powder being produced. However, when the controlling fluid jets device was switched on and $P_u$ was set to be 0.20 MPa, the backpressure was so controlled that backsplash was eliminated and the powder was produced as illustrated by the A038 production. Using controlling fluid to control the backpressure is demonstrated.

TABLE 2

| Experimental No. | First Peak μm | Second Peak μm | Second Peak/ First Peak |
|---|---|---|---|
| A035 | 177–250 | 53–74 | 0.36 |
| A036 | 250–420 | 53–74 | 0.24 |
| A037 | 250–420 | 88–105 | 0.31 |
| A038 | 250–420 | 53–74 | 0.18 |
| A039 | 250–420 | 53–74 | 0.17 |
| A040 | 250–420 | 53–74 | 0.17 |
| A042 | 177–250 | 53–74 | 0.34 |
| A043 | 177–250 | 53–74 | 0.75 |
| A044 | 250–420 | 53–74 | 0.29 |

Figure 10:
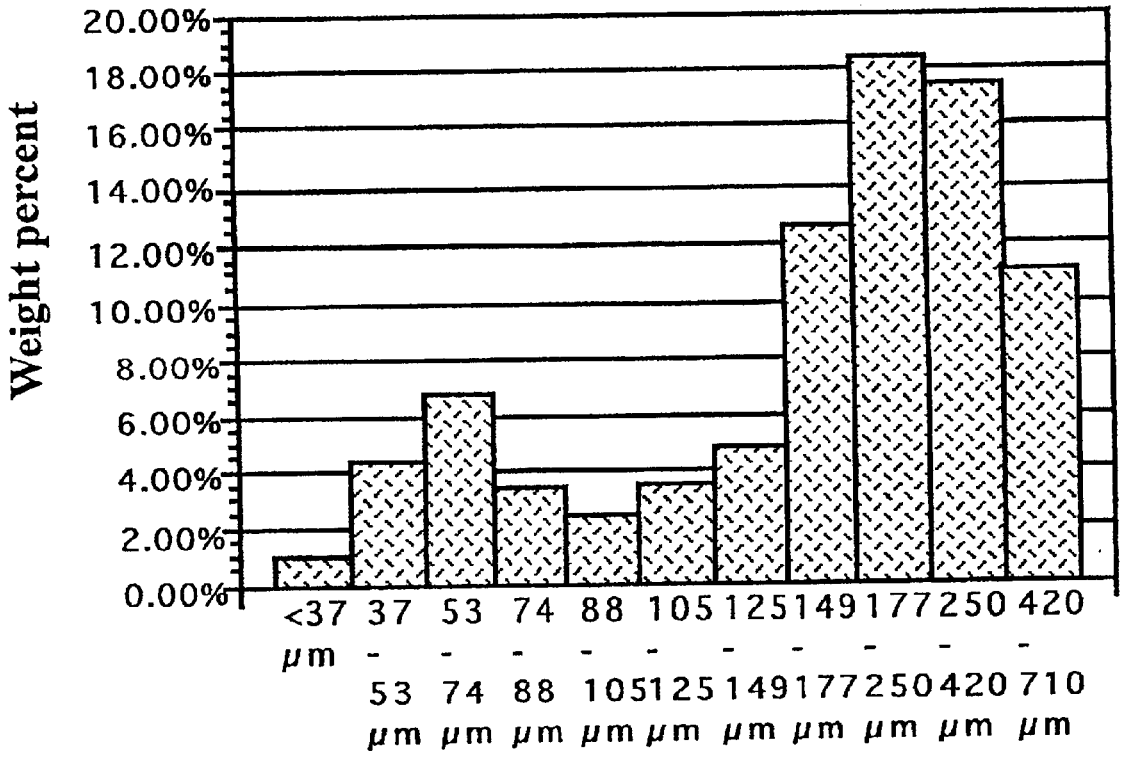
FIGS. 10(*a*) through 10(*i*) show the distributions of the powder sizes for each set of process parameters with the application of controlling fluid technique.
Figure 10:
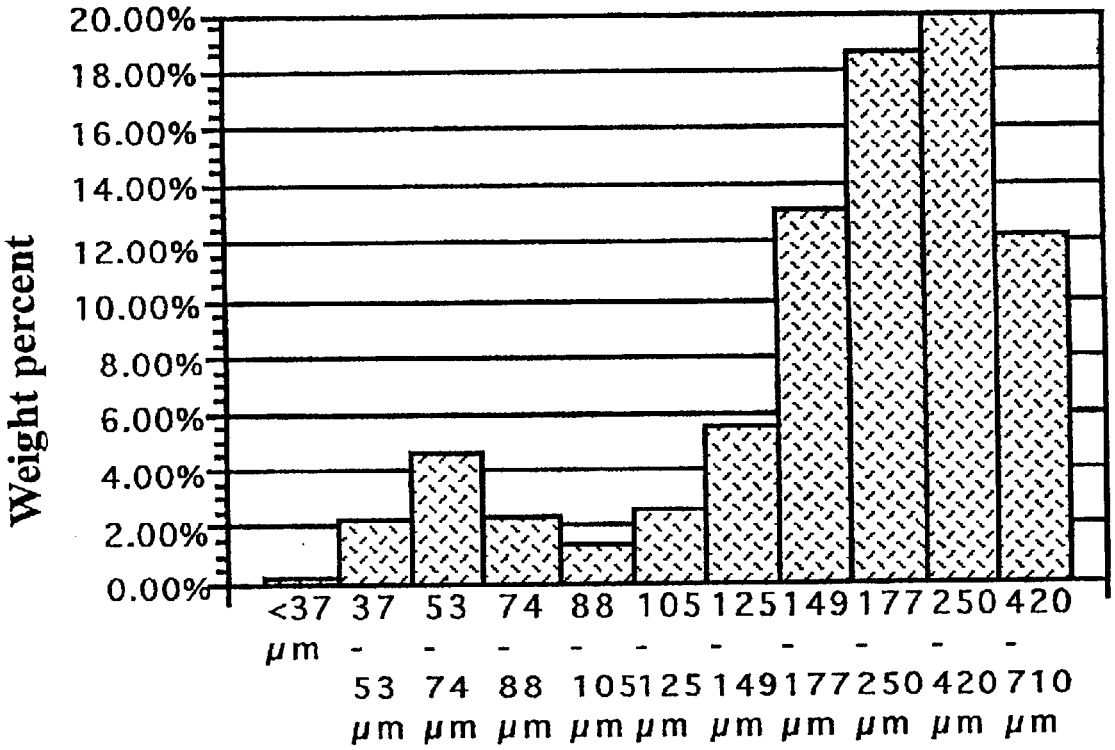
Figure 10:
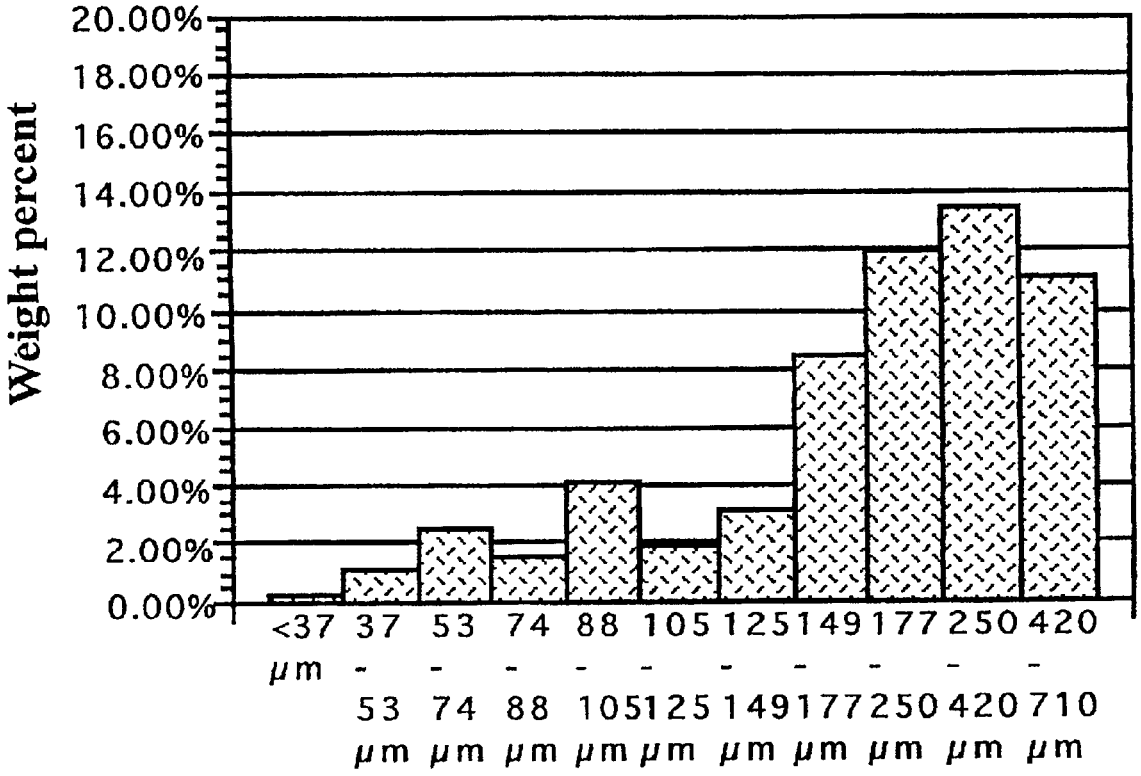
Figure 10:
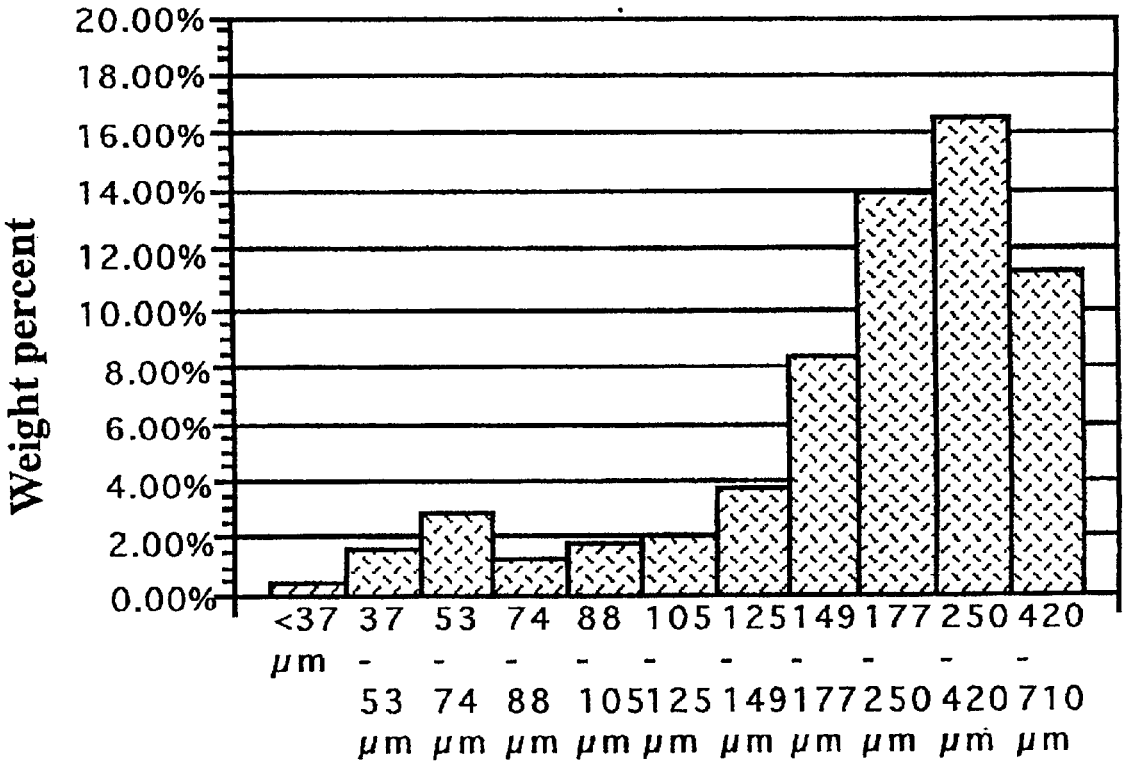
Figure 10:
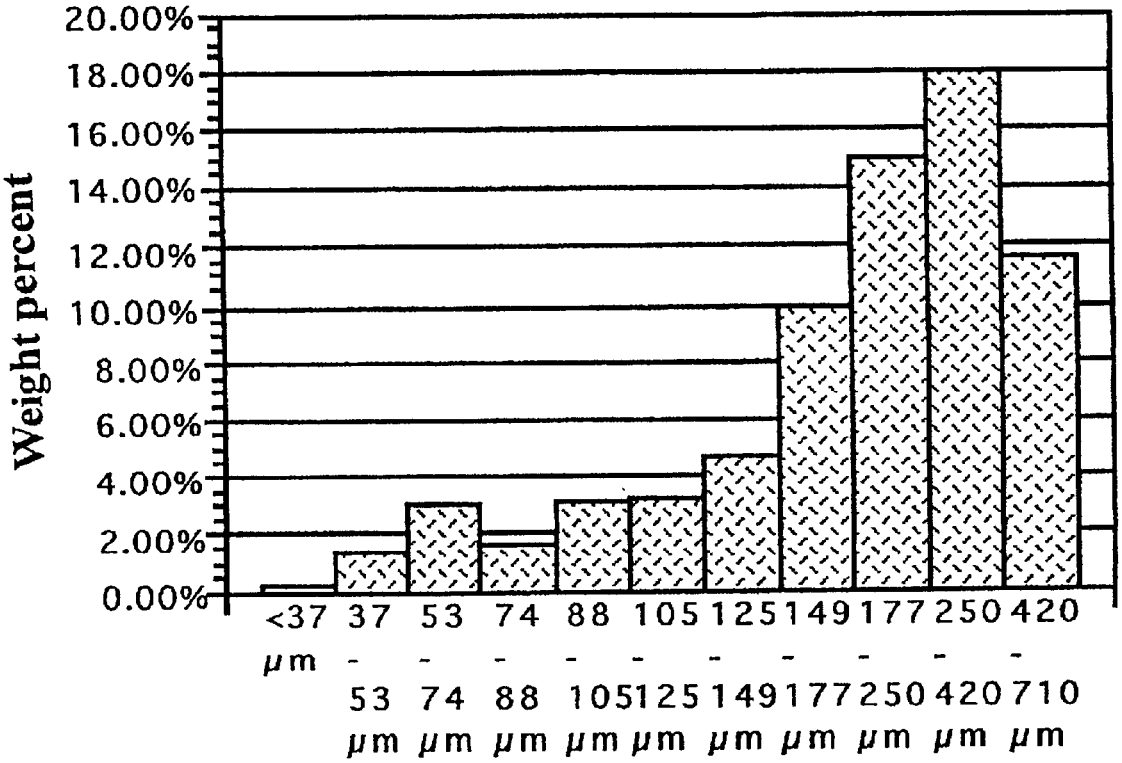
Figure 10:
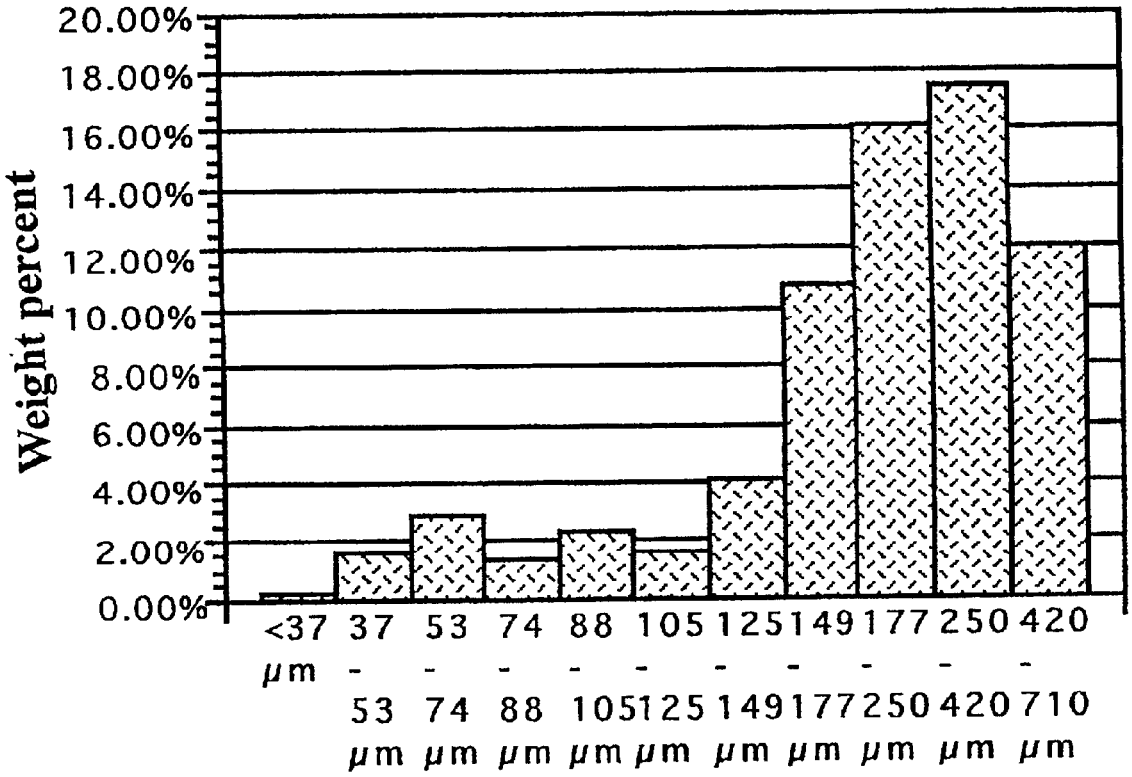
Figure 10:
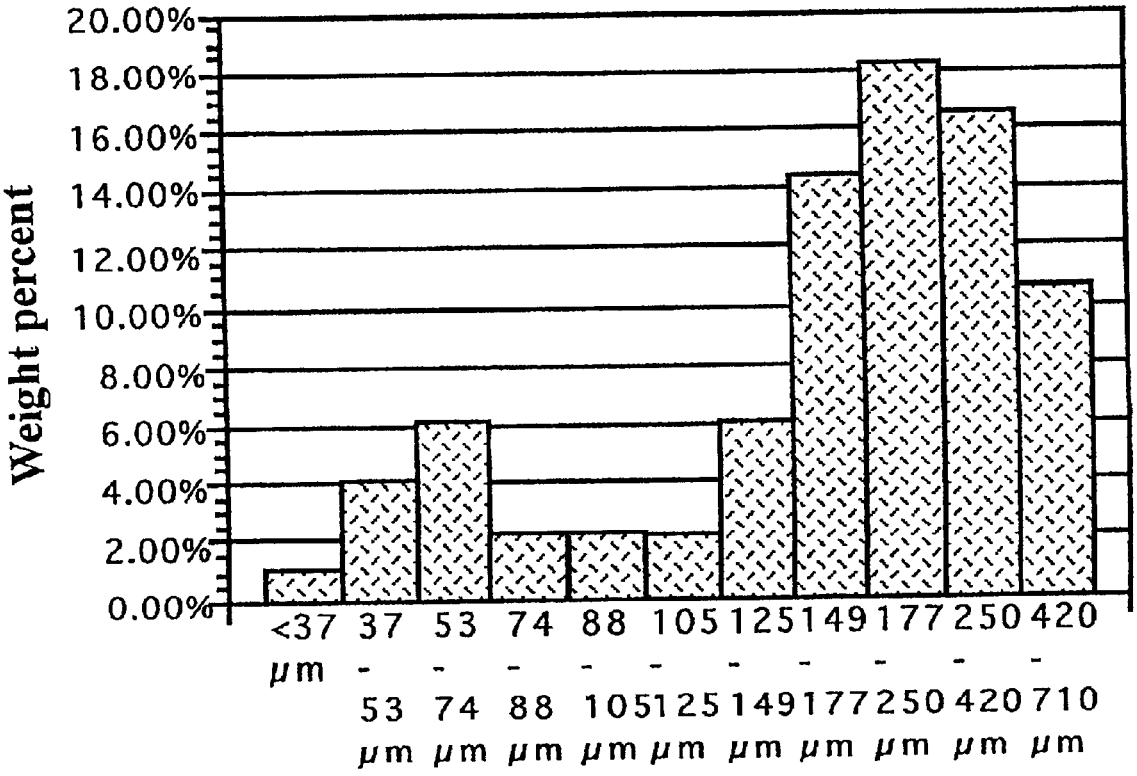
Figure 10:
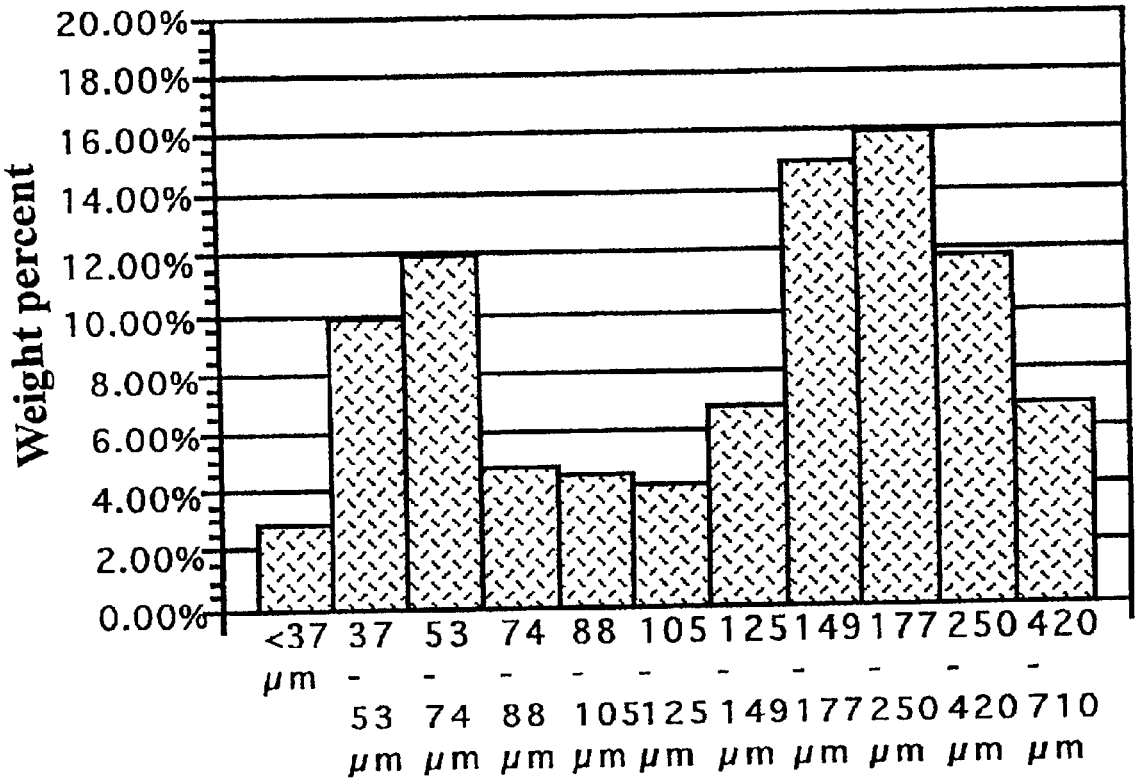
Figure 10:
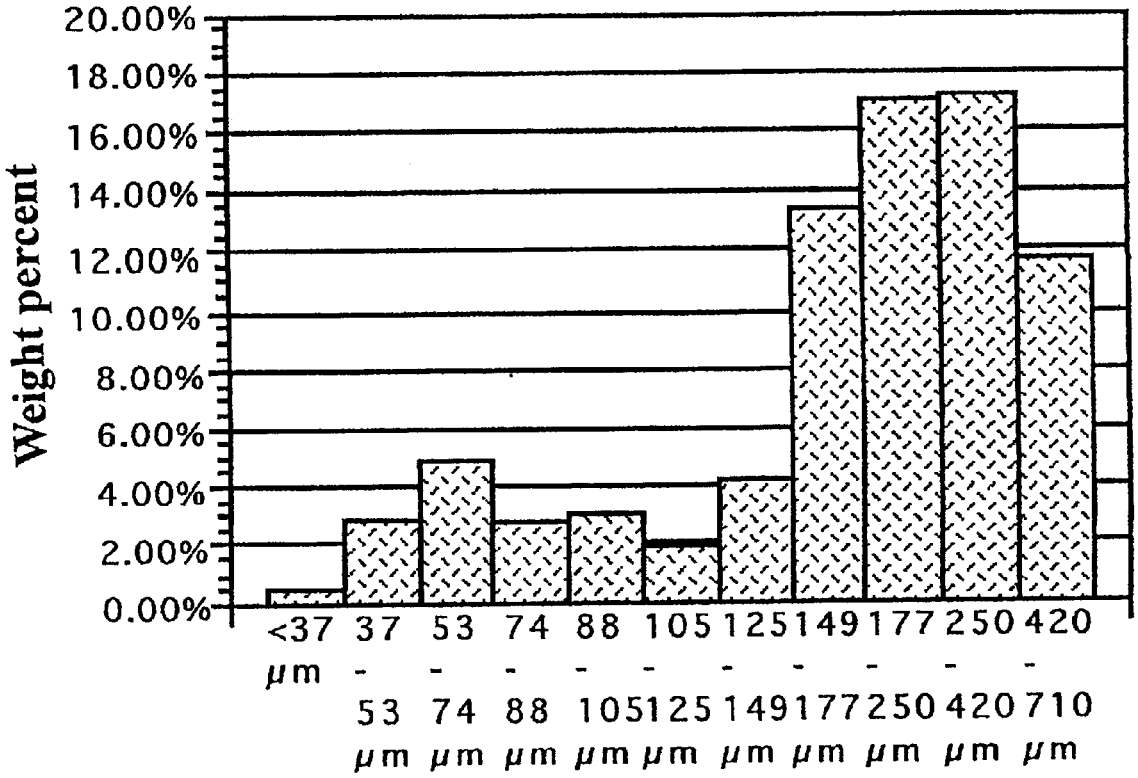
Figure 11:
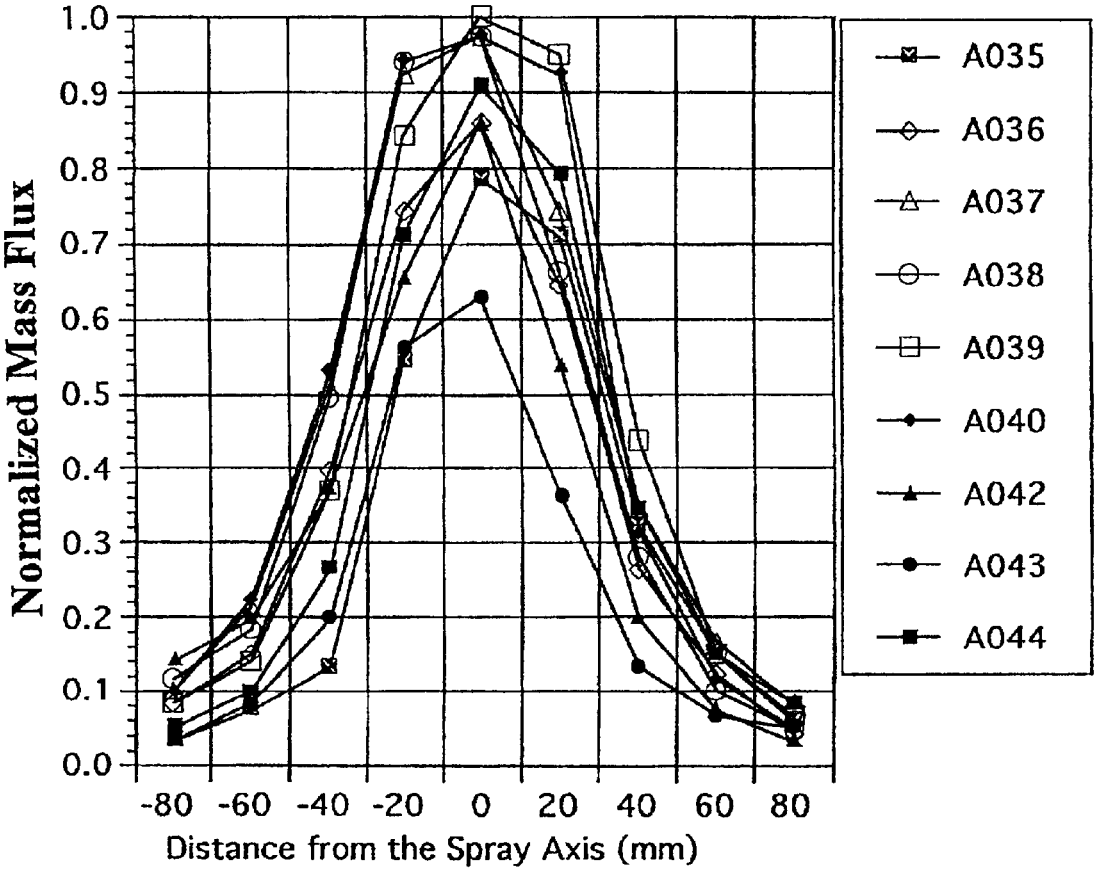
FIG. 11 shows the mass distribution of powders produced with the application of controlling fluid technique.

FIG. 10 shows the distributions of the powder sizes for each set of process parameters. It is shown that the first and second peak values of the distribution of powder sizes are controllable by varying the pressure and position of the controlling fluid jets. FIG. 11 shows the mass distribution of powders are controllable by varying the pressure and position of the controlling fluid jets. Using controlling fluid to control the atomization characteristics is demonstrated.

Figure 12:
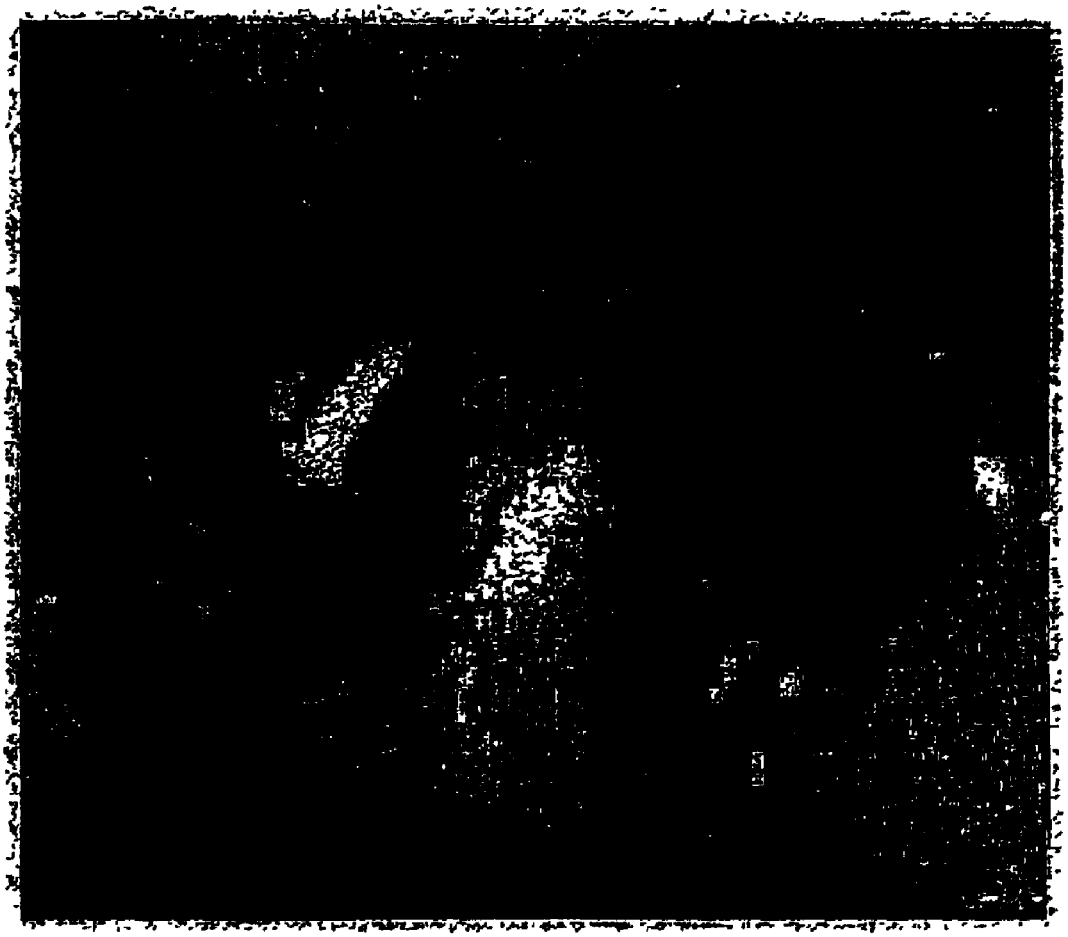
FIGS. 12(*a*) through 12(*g*) show the variations of the intensities and directions of the atomization gas jets as the pressure of the controlling fluid varies.
Figure 12:
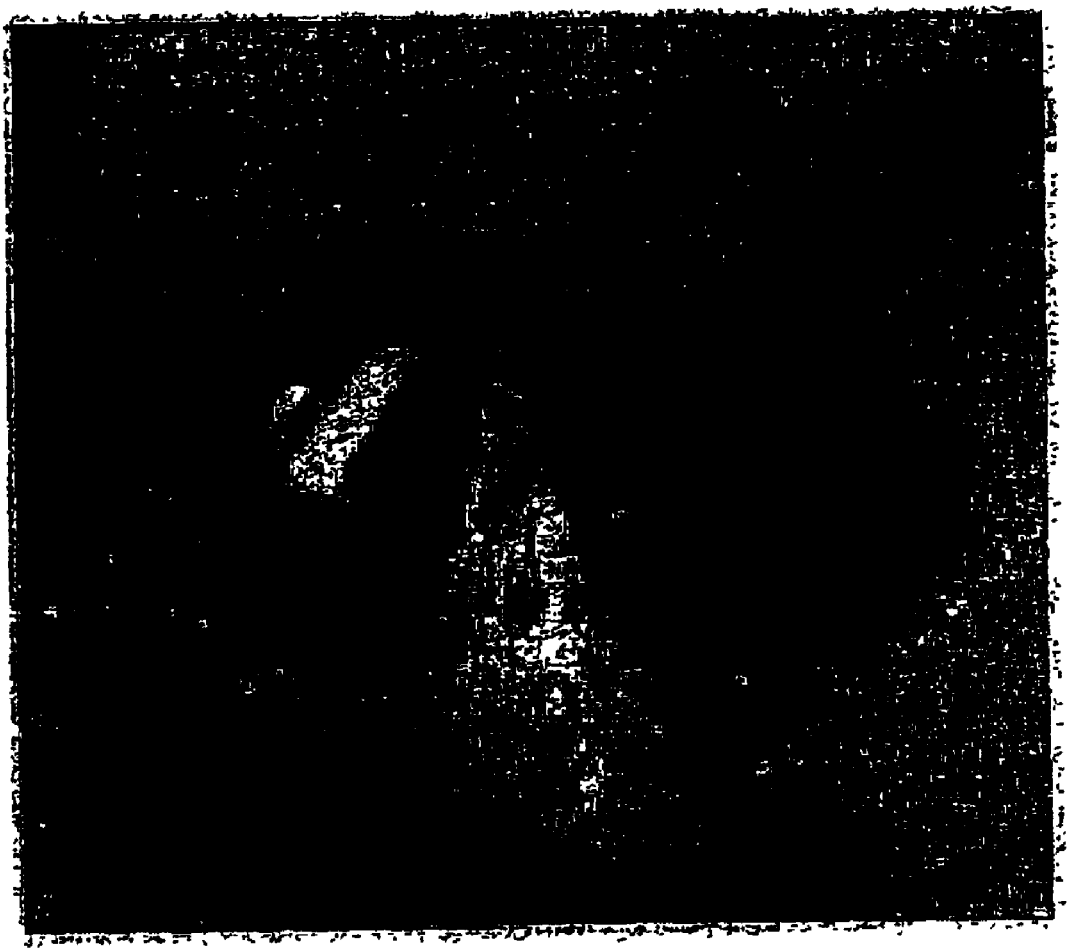
Figure 12:
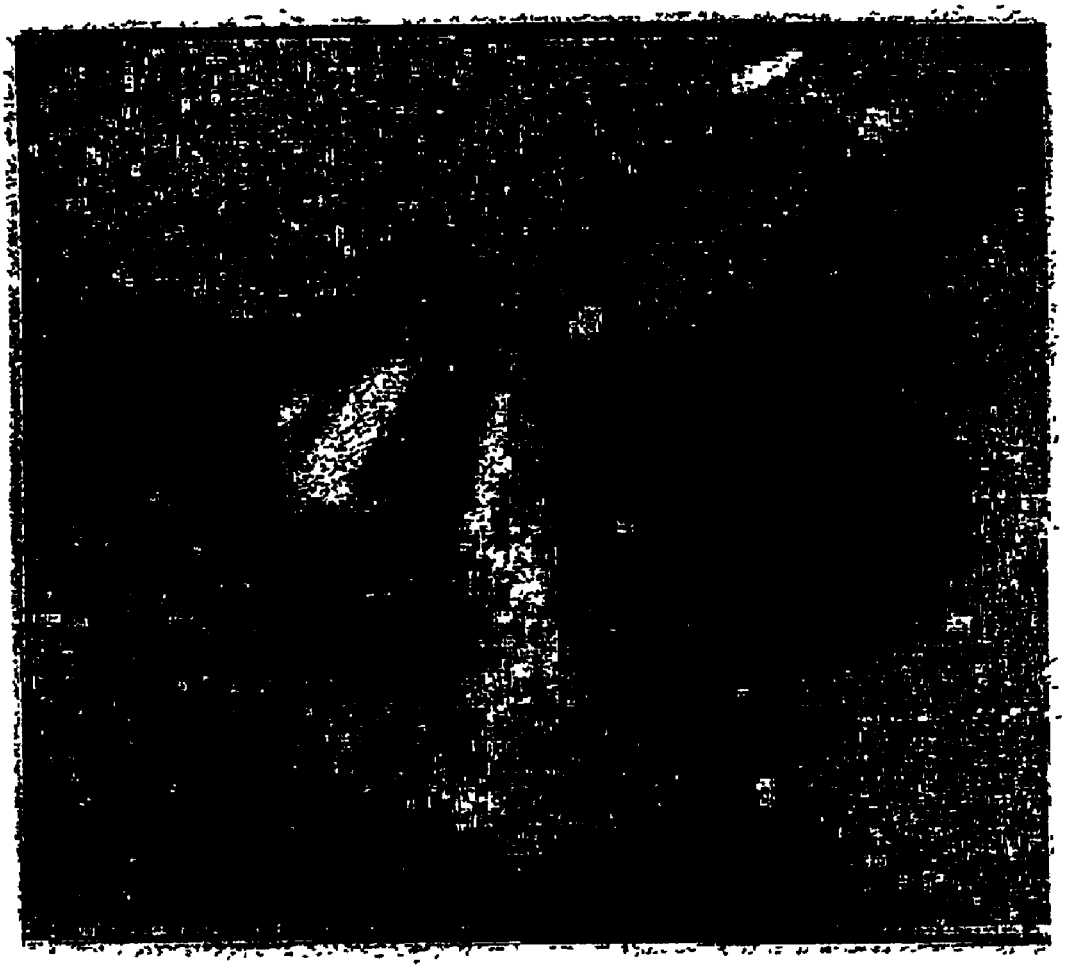
Figure 12:
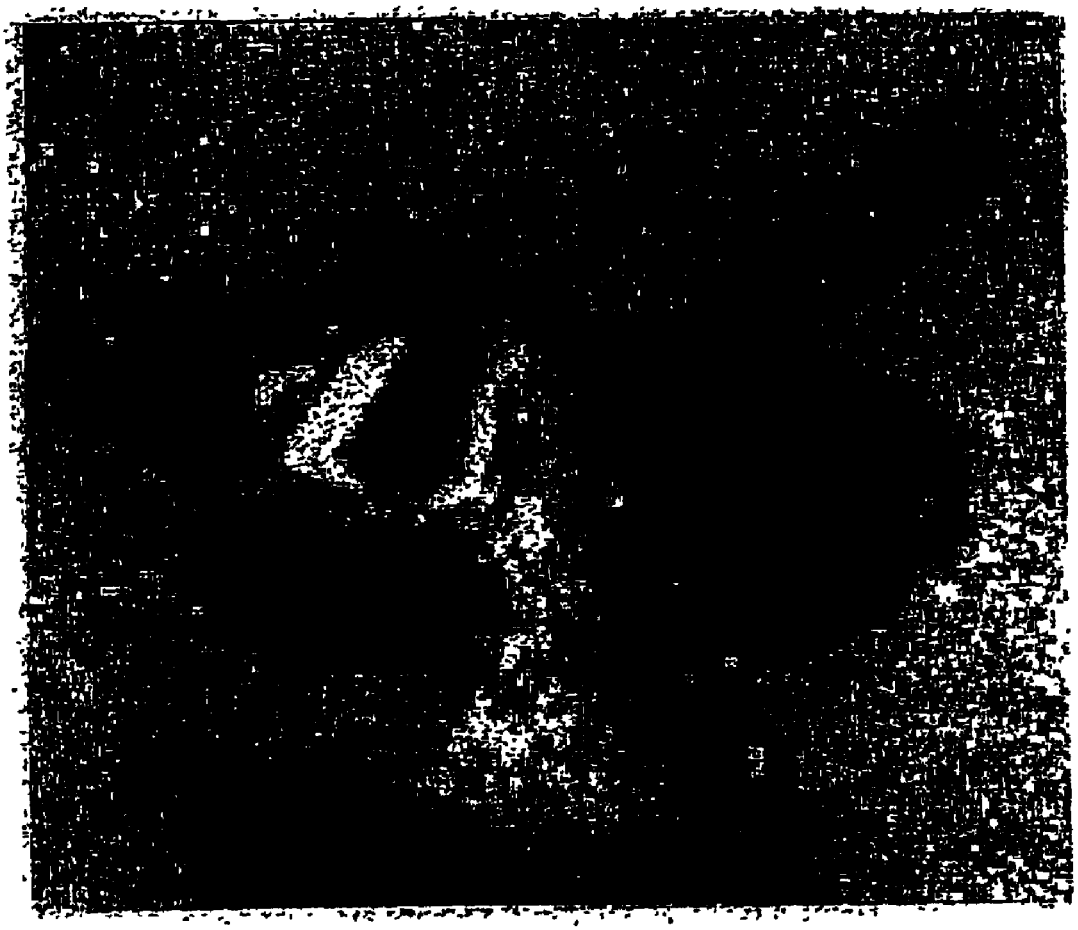
Figure 12:
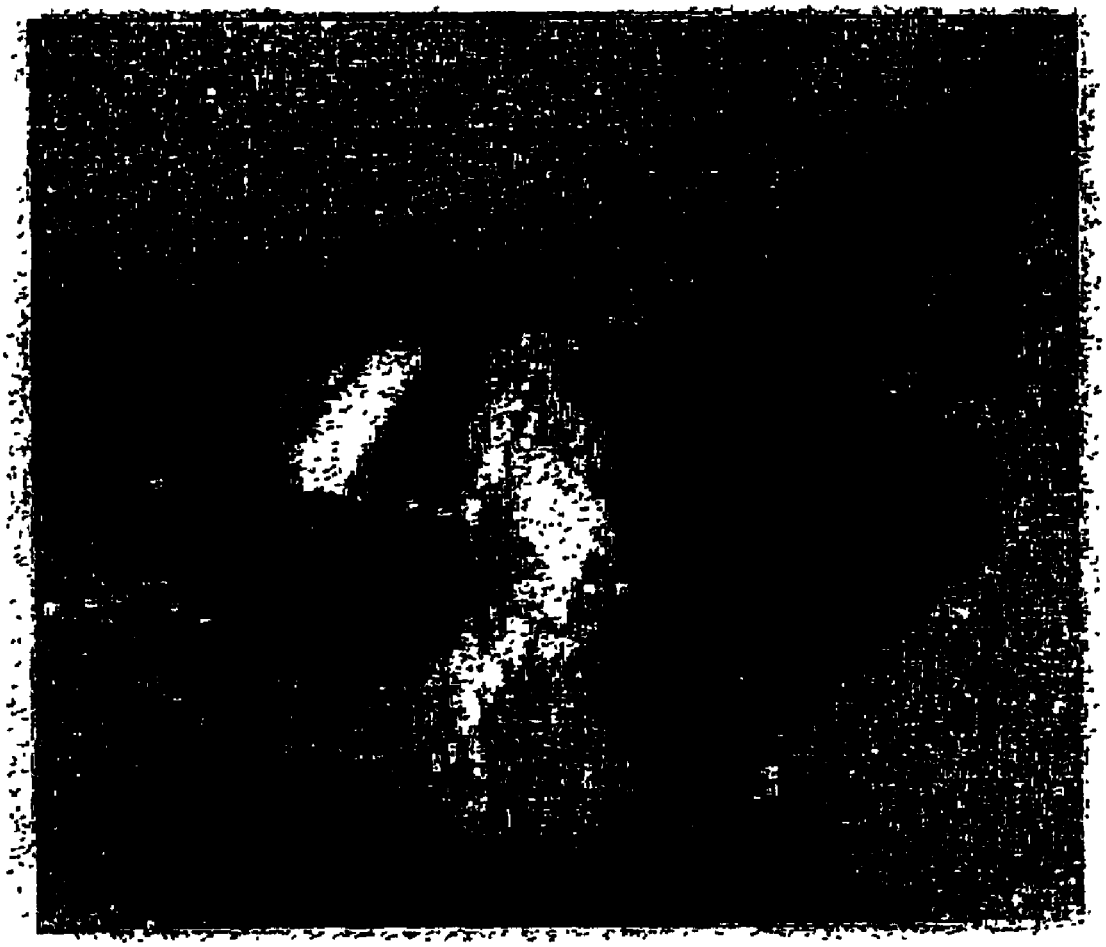
Figure 12:
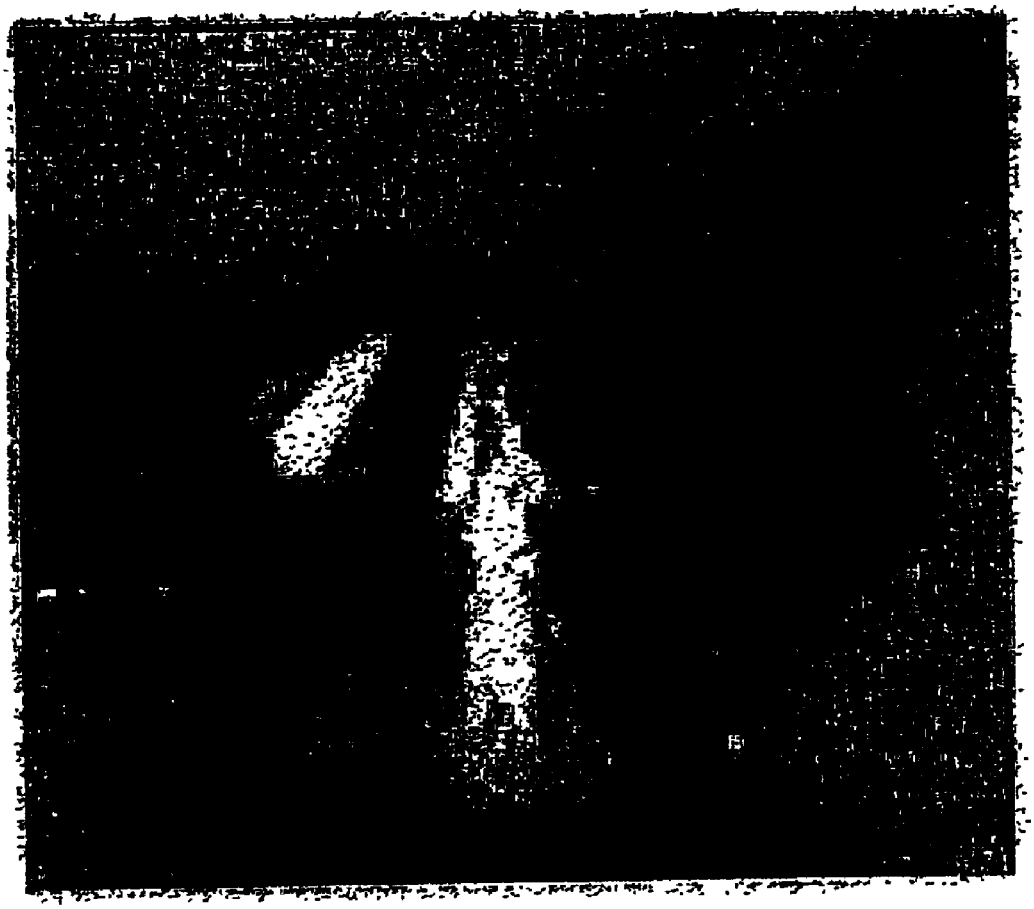
Figure 12:
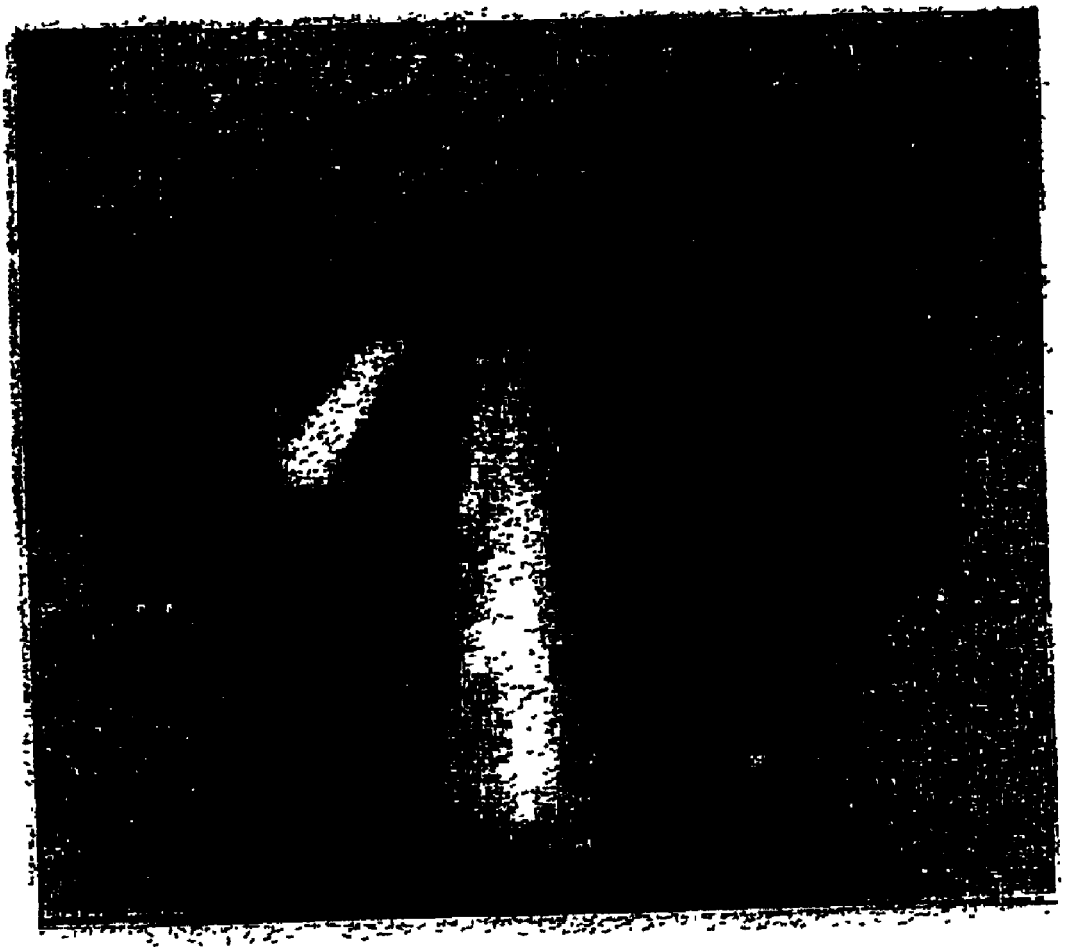

FIG. 12 shows the variations of the intensities and directions of the atomization gas jets as $P_u$ varies. It is shown that the intensity of the atomization gas jets for $P_u$=0.14 MPa is relatively small compared to that for $P_u$=0.40 MPa, which gives a more scattered spray for the former. In addition, the direction of the atomization gas jets for $P_u$=0.14 MPa is also different from that for $P_u$=0.40 MPa, and the former has a larger included angle for the spray cone. Using controlling fluid to control the intensities and directions of the atomization gas jets is demonstrated.

A further application of the use of controlling fluid is in the production of spray deposits. In the production of spray deposits, liquid metal or metal alloy is atomized into a spray of droplets, which consists of a mixture of fully liquid, semi-solid/semi-liquid and solid particles. The resulting spray of metal droplets is directed onto an appropriate collector, where a preform is continuously deposited by these droplets. The process is essentially a rapid solidification technique with an integrated gas-atomizing/spray depositing operation. Deposits with different morphologies, such as tubes, billets, flat products, coated articles, etc., can be produced by manipulating the movement and shape of the collector, and by, in many situations, moving the spray itself. Such products can either be used directly or can be further processed normally by hot or cold working with or without the collector.

During atomizing, the backpressure is controlled by the controlling fluid jets device, which controls the extent of the backsplash and the atomization rate, or the flow rate of the metal or metal alloy stream coming out of the liquid delivery nozzle. In addition, the intensities and directions of the atomization gas jets are controlled by the controlling fluid jets device, which controls the atomization characteristics. Consequently, the droplet characteristics, such as the variations of size, shape, temperature, heat content and microstructure of droplets, etc., and spray-deposit characteristics, such as the morphology, macrostructures and microstructures of the deposit, etc., are controlled. The pressure and/or flow rate of the controlling fluid are in-situ adjustable during atomizing to in-situ control the backpressure and/or the intensities and directions of the atomization gas jets. Alternatively, the secondary controlling fluid jets may be so arranged, through which solid particles or whiskers of the same or different composition (either metallic or non-metallic) of the metal to be atomized are introduced into the controlling fluid which acts as a transport vehicle for the particles or whiskers to be co-deposited with the atomized droplets to form spray-deposited composite materials. Alternatively, the particles or whiskers are introduced from above the controlling fluid jets, which also gives a mixture of the particles or whiskers with the spray to form spray-deposited composite materials.

EXAMPLE OF THE USE OF NITROGEN GAS AS THE CONTROLLING FLUID IN THE PRODUCTION OF SPRAY-DEPOSITED PB-50%SN ALLOY PREFORMS

The example below illustrates the conditions used for the production of Pb-50%Sn spray-deposited preforms. Table 3 lists the atomization process parameters used to produce Pb-50% Sn powder employing the controlling fluid technique.

| Process Parameter | Symbol | Example A | Example B |
|---|---|---|---|
| Metal Dispensing Temperature (° C.) | $T_{spray}$ | 266 | 266 |
| Metal Flow Rate (Kg/sec) | $J_{melt}$ | 0.18 | 0.18 |
| Atomization gas pressure (MPa) | $P_1$ | 0.30 | 0.30 |
| Controlling fluid pressure | $P_u$ | 0.00 | 0.20 |
| Vertical distance between the controlling fluid jets device and gas atomization device (mm) | R | 20 | 20 |
| Spray Height (mm) | Z | 600 | 600 |
| Results | | Process Failed | Process Succeeded |

In Example A, only atomization gas was used in the conventional manner of production of spray-deposited preforms. However, since the backsplash created due to the backpressure was so severe that nearly no atomization took place, which resulted in no preform being produced. In Example B, controlling fluid of Nitrogen was introduced by the controlling fluid jets device above the main atomization gas jets. Otherwise, the atomizing was carried out under identical conditions to Example A. The backpressure was so controlled by the controlling fluid jets device that backsplash was eliminated and a spray-deposited preform was produced. Using controlling fluid to control the backpressure in the spray deposition process was demonstrated.

Accordingly, it is to be understood that the embodiments of the invention herein described are merely illustrative of the application of the principles of the invention. Reference herein to details of the illustrated embodiments is not intended to limit the scope of the claims, which themselves recite those features regarded as essential to the invention.

| Reference Number of Elements In The Drawings | |
|---|---|
| 1 | crucible or tundish |
| 2 | liquid metal or metal alloy |
| 3 | liquid delivery nozzle |
| 4 | liquid metal or metal alloy stream |
| 5 | primary gas atomization device |
| 6 | primary atomization gas jets |
| 7 | a spray of atomized droplets |
| 8 | a secondary controlling fluid jets device |
| 9 | controlling fluid jets |
| 10 | atomization zone |
| 11 | sensors, such as Phase-Doppler Anemometry (PDA) |
| 12 | central process unit, such as computer |
| 13 | position driver of primary gas atomization device |
| 14 | position driver of secondary controlling fluid jets device |
| 15 | crucible/tundish metal dispensing system |
| 16 | liquid metal |
| 17 | the gas atomization device |
| 18 | the secondary controlling fluid jets device |
| 19 | inlet pipe |
| 20 | separate inlet pipe |
| 21 | a spray chamber |
| 22 | a powder collection vessel |
| 23 | a gas exhaust pipe |
| 24 | a current to pneumatic pressure(P/I) converter |
| 25 | controlling fluid control valve |
| 26 | sensors, such as Phase-Doppler Anemometry (PDA) |
| 27 | central process unit, such as computer |
| 28 | position driver of primary gas atomization device |
| 29 | horizontal actuator of primary gas atomization device |
| 30 | vertical actuator of primary gas atomization device |
| 31 | position driver of secondary controlling fluid jets device |
| 32 | horizontal actuator of secondary controlling fluid jets device |
| 33 | vertical actuator of secondary controlling fluid jets device |

What is claimed is:

1. An atomizing apparatus for the production of powders or spray deposits, the apparatus comprising:

an atomization device for receiving a liquid stream of molten metal or metal alloy to be atomized;

at least two primary atomization gas jets for directing an atomization gas at an angle into the liquid stream in an atomization zone at an impinging point of the atomization jets to break the stream into atomized droplets; and at least two secondary jets for directing a controlling fluid at a pressure, flow rate and direction, the jets being aimed at the atomization gas jet or into the atomization zone, wherein said secondary jets control a backpressure generated by the primary atomization gas jets; and means for in-situ controlling at least one of the relative positions among the primary atomization jets, the secondary jets, and the liquid delivery nozzle.

2. The apparatus of claim 1 wherein the pressure, direction and/or flow rate of the controlling fluid are adjustable during atomizing such that the backpressure and/or an intensity or direction of the primary atomization gas jets are controlled by adjusting the pressure, direction and/or flow rate of the controlling fluid.

3. The apparatus of claim 1 wherein the controlling fluid is in a gaseous phase, or in a mixture of gaseous phases.

4. The apparatus of claim 1 wherein the controlling fluid is cryogenic liquefied gas which changes to a gaseous phase upon heating by the metal or metal alloy stream.

5. The apparatus of claim 1 further comprising a spray chamber enclosing at least the primary atomization gas jets, the secondary jets and the atomization zone.

6. The apparatus of claim 1 wherein the liquid stream is atomized into a powder, and the apparatus further comprises a powder collector disposed to collect the powder produced by the atomization of the liquid stream.

7. The apparatus of claim 1 wherein the liquid stream is atomized and forms spray deposits, and the apparatus further comprises a collector disposed in the path of the atomized droplets, such that the atomized droplets form a deposit on the collector.

8. The apparatus of claim 7 wherein the collector is movable relative to the spray.

9. The apparatus of claim 7 wherein the apparatus producing the atomized liquid stream is movable relative to the position of the collector during atomizing.

10. The apparatus of claim 7 further comprising means for introducing solid particles into the controlling fluid, such that the controlling fluid introduces the particles into the liquid stream such that they are co-deposited on the collector with the atomized droplets.

11. The apparatus of claim 10 wherein the solid particles are introduced into the secondary jets from above.

12. The apparatus of claim 1, wherein at least one of the pressure, flow rate or direction of the secondary jets is controlled, such that at least one parameter of the atomization to be controlled is selected from the group consisting of: atomization efficiency, atomization rate, cooling rate of atomized droplets, trajectories and velocities of atomized droplets, shapes of atomized droplets, sizes of atomized droplets, and spatial flux distribution of atomized droplets.

13. The apparatus of claim 1, in which the means for in-situ controlling at least one of the relative positions comprises a position driver coupled to at least one primary atomization jet.

14. The apparatus of claim 13, in which the position driver moves the at least one primary atomization jet both horizontally and vertically.

15. The apparatus of claim 1, in which the means for in-situ controlling at least one of the relative positions comprises a position driver coupled to at least one secondary jet.

16. The apparatus of claim 15, in which the position driver moves the at least one secondary jet both horizontally and vertically.

17. An atomizing apparatus for the production of powders or spray deposits, the apparatus comprising:

an atomization device for receiving a liquid stream of molten metal or metal alloy to be atomized;

at least two primary atomization gas jets for directing an atomization gas at an angle into the liquid stream in an atomization zone at an impinging point of the atomization jets to break the stream into atomized droplets; and at least two secondary jets for directing a controlling fluid at a pressure, flow rate and direction, the jets being aimed at the atomization gas jet or into the atomization zone, wherein said secondary jets control a backpressure generated by the primary atomization gas jets;

and means for in-situ controlling at least one of the relative positions among the primary atomization jets, the secondary jets, and the liquid delivery nozzle; said means including at least one sensor for detecting atomization characteristics positioned adjacent to the atomization device, and a central process unit coupled to the at least one sensor and to the means for in-situ controlling, wherein the position of at least one of the primary atomization jets, secondary jets and liquid delivery nozzle is controlled by the central process unit based upon data from the sensor.

18. An atomizing apparatus for the production of powders or spray deposits, the apparatus comprising:

an atomization device for receiving a liquid stream of molten metal or metal alloy to be atomized;

at least two primary atomization gas jets for directing an atomization gas at an angle into the liquid stream in an atomization zone at an impinging point of the atomization jets to break the stream into atomized droplets; and at least two secondary jets for directing a controlling fluid at a pressure, flow rate and direction, the jets being aimed at the atomization gas jet or into the atomization zone, wherein said secondary jets control a backpressure generated by the primary atomization gas jets;

and means for in-situ controlling at least one of the relative positions among the primary atomization jets, the secondary jets, and the liquid delivery nozzle; said means including at least one phase-Doppler anemometry sensor for detecting atomization characteristics positioned adjacent to the atomization device, and a central process unit coupled to the at least one phase Doppler anemometry sensor and to the means for in-situ controlling, wherein the position of at least one of the primary atomization jets, secondary jets and liquid delivery nozzle is controlled by the central process unit based upon data from the sensor.

* * * * *